US009623937B2

(12) United States Patent
Moffat, III et al.

(10) Patent No.: US 9,623,937 B2
(45) Date of Patent: Apr. 18, 2017

(54) MULTI-USE CONFIGURABLE WATERCRAFT

(71) Applicants: John David Moffat, III, Bonita, CA (US); Kasey Campbell, San Diego, CA (US)

(72) Inventors: John David Moffat, III, Bonita, CA (US); Kasey Campbell, San Diego, CA (US)

( * ) Notice: Subject to any disclaimer, the term of this patent is extended or adjusted under 35 U.S.C. 154(b) by 291 days.

(21) Appl. No.: 14/187,155

(22) Filed: Feb. 21, 2014

(65) Prior Publication Data

US 2014/0242857 A1 Aug. 28, 2014

Related U.S. Application Data

(60) Provisional application No. 61/768,191, filed on Feb. 22, 2013.

(51) Int. Cl.

| | |
|---|---|
| ***B63H 20/02*** | (2006.01) |
| ***B63B 35/73*** | (2006.01) |
| ***B63B 7/02*** | (2006.01) |
| ***B63B 43/14*** | (2006.01) |
| *B63B 1/10* | (2006.01) |
| *B63B 3/08* | (2006.01) |

(52) U.S. Cl.

CPC ..... *B63B 35/73* (2013.01); *B63B 7/02* (2013.01); *B63B 43/14* (2013.01); *B63H 20/02* (2013.01); *B63B 2001/102* (2013.01); *B63B 2003/085* (2013.01)

(58) Field of Classification Search

CPC ..... B63B 7/04

See application file for complete search history.

(56) References Cited

U.S. PATENT DOCUMENTS

| | | | | | |
|---|---|---|---|---|---|
| 3,116,708 | A * | 1/1964 | Gardhouse | B63B 1/14 | 114/123 |
| 4,621,587 | A * | 11/1986 | Pool | B63B 1/121 | 114/343 |
| 4,637,332 | A * | 1/1987 | Glime | B63H 20/10 | 114/61.23 |
| 4,690,649 | A * | 9/1987 | Zeimet | B63H 20/06 | 114/347 |
| 5,265,550 | A * | 11/1993 | Harper, Jr. | B63B 1/14 | 114/283 |
| 6,240,865 | B1 * | 6/2001 | Hubbard | B63B 1/125 | 114/39.28 |

* cited by examiner

*Primary Examiner* — Edwin Swinehart
(74) *Attorney, Agent, or Firm* — Thibault Patent Group

(57) ABSTRACT

A variety of multi-use, configurable watercraft is disclosed. A first type of watercraft used in a first water-based activity may be used as a component in a second type of watercraft used in a second water-based activity. For example, a stand-up paddleboard (SUP) may be used for paddle boarding, and then converted into a kayak, sailboat, catamaran, motorboat, or other type of vessel by adding one or more components to the SUP. In one embodiment, two paddleboards are used to construct a variety of multi-hull watercraft.

8 Claims, 27 Drawing Sheets

MULTI-USE CONFIGURABLE WATERCRAFT

RELATED APPLICATIONS

This application claims the benefit under 35 U.S.C. 119(e) to U.S. Provisional Patent Application Ser. No. 61/768,191, filed Feb. 22, 2013, entitled "DESCRIPTIONS OF PADDLE CAT CONCEPT DRAWINGS", incorporated by reference in its entirety herein.

BACKGROUND

I. Field of Use

The present application relates to the field of recreational watercraft. More specifically, the present invention relates to a multi-use watercraft that can be configured for various watercraft activities, such as paddle boarding, kayaking, sailing, fishing, canoeing, catamaraning, etc.

II. Description of the Related Art

Recreational watercraft activities have been popular for many years in the United States and abroad. Millions of people enjoy activities such as canoeing, kayaking, sailing, fishing, catamaraning and, more recently, paddle boarding. Each one of these activities requires the use of a particular type of watercraft specially designed for each particular activity. For example, canoes are designed for a single type of activity, that is, canoeing, and generally cannot be used for activities such as paddle boarding or sailing. Often times individuals who enjoy one type of water-based activity typically enjoy other water-based activities as well.

There are a number of drawbacks to individuals interested in participating in a number of water-based activities. For example, such individuals must obtain a watercraft particularly suited for each type of water-based activity that the individuals engage in. Thus, participating in multiple, water-based activities may be an expensive proposition, as at least one type of watercraft must be purchased or rented for each type of water-based activity. Further, watercraft used in the aforementioned activities tends to be large and bulky, requiring large amounts of storage space. Additionally, transportation of such watercraft is usually limited to one type of watercraft or the other, for example, on an automobile roof-mounted rack or even a tow trailer, due to the large size and bulk of each type of watercraft. Finally, water conditions might not be suitable for a selected water-based activity, unknown to an individual until he or she arrives on the waterfront. Thus, it may be determined only after arrival at a waterfront that water conditions favor sailing, but not canoeing. In this example, an individual may have transported a canoe to the waterfront, only to find out that the water and wind conditions favor sailing.

What is needed, then, is a watercraft design that can alleviate the problems mentioned above.

SUMMARY

The embodiments described herein relate to a variety of multi-use, configurable watercraft. In one embodiment, a multi-use, configurable watercraft comprises a hull, configured for a first type of water-based activity, the hull comprising at least two sockets formed into a top surface of the hull and spaced apart from each other along a longitudinal axis of the hull, each of the sockets for receiving a respective structure for configuring the hull for a second type of water-based activity, and at least two socket covers, each socket cover for covering a respective one of the at least two sockets when the hull is configured for the first type of water-based activity.

BRIEF DESCRIPTION OF THE DRAWINGS

The features, advantages, and objects of the embodiments discussed herein will become more apparent from the detailed description as set forth below, when taken in conjunction with the drawings in which like referenced characters identify correspondingly throughout, and wherein.

DETAILED DESCRIPTION

The inventive concepts described herein relate to multi-use, configurable watercraft for use in recreational watercraft activities. For example, in one embodiment, a single-hull vessel, such as a paddleboard, kayak, surfboard, or other floatation device may be used as intended, i.e., for paddle boarding, kayaking, and surfing, respectively, and then quickly and easily converted into another type of vessel or watercraft, such as a single-hull sailboat/sailboard, with an addition of a mast, sail, and or rudder, or a double-hull catamaran with the addition of a second vessel and connecting apparatus, as will be explained below. The single-hull vessels may, in one embodiment, comprise features that allow conversion between one type of vessel or watercraft and another. In other embodiments, two or more single-hull vessels may be joined to form multi-hull vessels, such as outrigger canoes, catamarans, dual-hull sailboats, dual-hull motorboats, etc. It should be understood that although the conventional term "watercraft" and "vessel" may be commonly known to describe large ships, boats, or other large, complex marine vehicles, these terms may be used interchangeably herein to describe smaller and simpler marine vehicles, such as paddleboards, surfboards, kayaks, canoes, catamarans, motorboats, or sailboats in either a single or multi-hull design.

Figure 1:
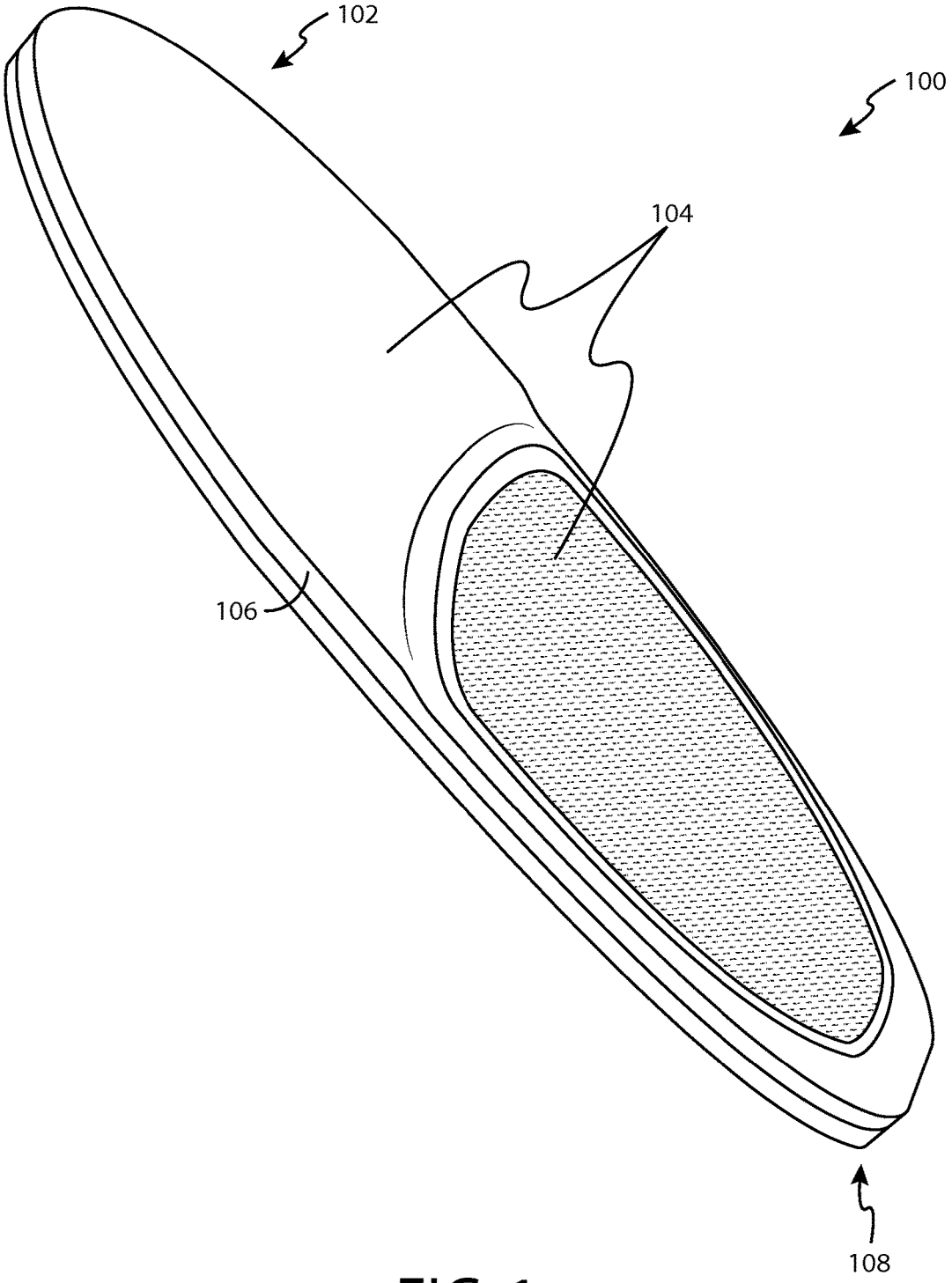
FIG. 1 is a perspective view of a conventional paddleboard.

FIG. 1 is a perspective view of a conventional paddleboard 100, comprising front end 102, top surface 104, left edge or rail 106, and tail section 108. Not shown in this figure is a right edge, bottom surface due to the angle at which the paddleboard 100 is shown, however such features are readily apparent to one skilled in the art. Paddleboard 100 may be used by participants who are propelled by a swimming motion using their arms while lying or kneeling on top surface 104 in the ocean. Alternatively, paddleboard 100 comprises a type that is used for stand-up paddle boarding, where participants stand on top surface 104 and use a long paddle to propel themselves through the water. Paddle boarding is usually performed in the open ocean, however can be enjoyable on lakes, rivers, ocean bays, and canals. The bottom surface of paddleboard 100 may be curved slightly so that front end 102 rises out of the water while being used, thus preventing front end 102 from "pearling", or being submerged in the water, sometimes causing the paddleboard 100 to pitch forward, causing a loss of balance by the paddle boarder. Front end 102, in some embodiments, is thicker than the remaining portion of paddleboard 102, in order to add buoyancy.

While paddle boarding has gained tremendous acceptance in recent years, it would be desirable to use paddleboard 100 in other ways in order for individuals to enjoy a diversity of water-based activities. Thus, the watercraft shown in FIG. 2 was devised.

Figure 2:
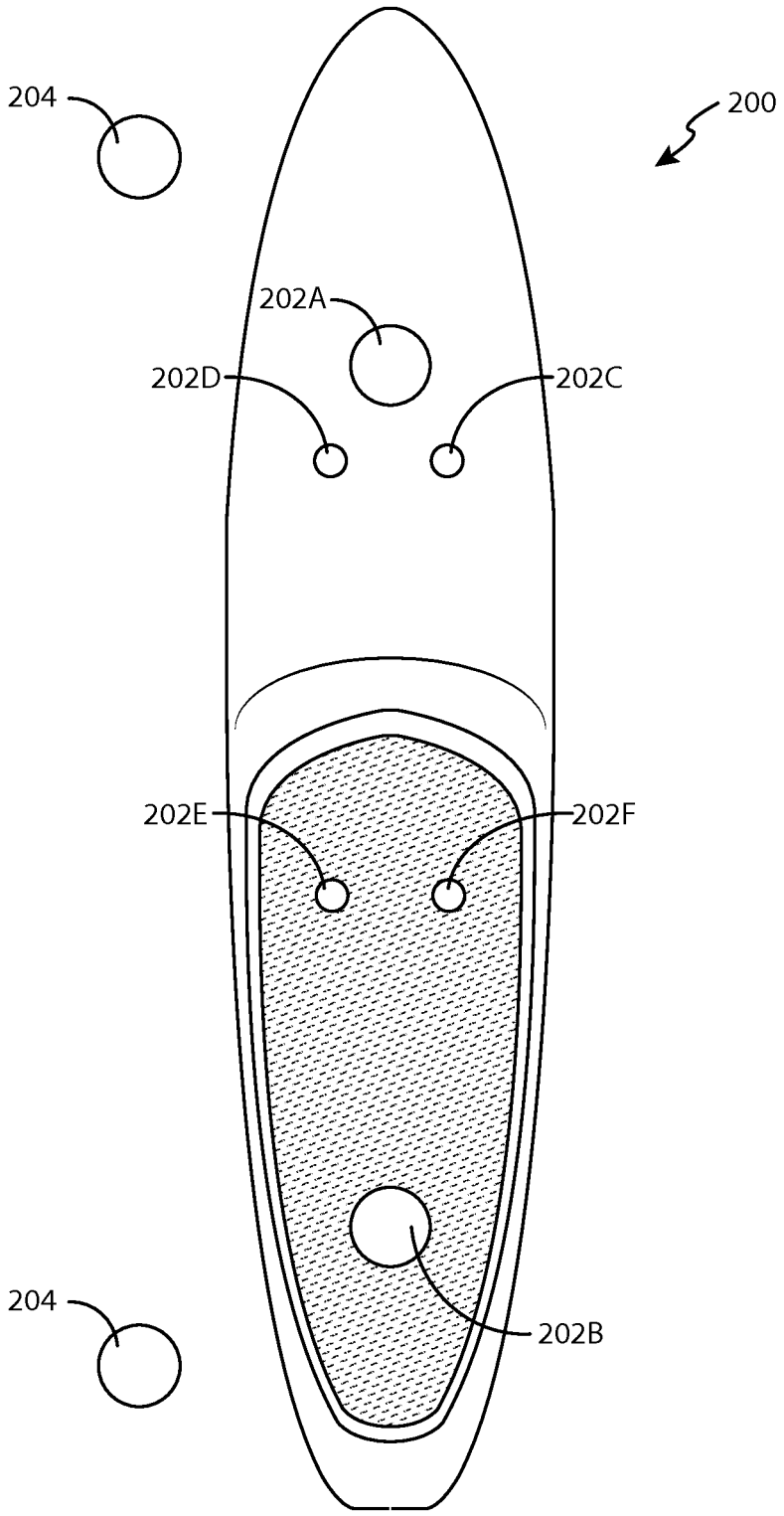
FIG. 2 is a plan view of one embodiment of a watercraft suitable for a first water-based activity, while also being configurable for a second water-based activity.

FIG. 2 is a plan view of one embodiment of a watercraft 200 configured for use in a first water-based activity, while also being capable of being configured for a second water-based activity. For example, watercraft 200 shown in this embodiment comprises a stand-up paddleboard (SUP) for use in paddle boarding, and can be quickly and easily converted into an outrigger paddleboard, a sailboat, or a motorboat, as will be described later herein. Additionally, watercraft 200 can be combined with a second watercraft 200 to form multi-hull vessels, such as catamarans, dual-hull paddleboards, dual-hull canoes, dual-hull sailboats, and dual-hull motorboats. It should be understood that while watercraft 200 comprises a stand-up paddleboard, in other embodiments, watercraft 200 comprise other types of watercraft, such as a traditional paddleboard, surfboard, kayak or other single-hull watercraft.

Watercraft 200 comprises one or more sockets formed onto top surface 104 and, in some embodiments, the sockets may be sized differently. For example, in FIG. 2, watercraft 200 comprises a number of circular sockets, shown as large sockets 202*a* and 202*b* and small sockets 202*c*, 202*d*, 202*e*, and 202*f*. However, the sockets may comprise different shapes, such as squares, rectangles, triangles, ovals, etc. The sockets may be used to connect various structures to watercraft 200 in order to configure watercraft 200 for use in a second, water-based activity. For example, the sockets may receive various cross-members, outrigger tubes, benches, seats, or other structures useful in configuring watercraft 200 for use in the second water-based activity.

The size of the sockets is selected, in part, based on a type of structure installed into the sockets. Generally, the greater the force exerted by a structure on the sockets, the larger diameter and greater depth a socket should be. For example, sockets that receive outrigger tubes or cross-members may experience a relatively higher degree of force than sockets that receive benches or seats, as will be described later herein. Thus, such sockets 202*a* and 220*b* may comprise a relatively large diameter, such as 8 inches and be relatively deep, such as 3 inches, while smaller sockets 202*c*-202*f* might comprise a diameter of 4 inches and be 1 or 2 inches deep or smaller. In other embodiments, however, the depth of the sockets may be more important than the diameter when determining socket dimensions. For example, a deep but relatively small-diameter socket may be able to better accommodate a relatively large load than shallower, larger-diameter socket.

One factor in determining the load experienced by any socket is the number of structures supported by each socket. For example, in some embodiments, a socket may receive a cross-member that connects a first watercraft 200 to a second watercraft 200 and the cross-member may additionally support a bench or bench-supporting structure. Thus, the socket size and/or depth should be increased to support the additional load associated with multiple structures.

In one embodiment, the sockets comprise "twist-lock" sockets that are configured to receive structures having a reciprocal physical structure. For example, in one embodiment, a socket may comprise a circular depression in top surface 104 having a ramped thread extending away from an interior wall of the depression, similar to a screw thread, while an outrigger tube may comprise a plug that is formed to substantially conform to the depth and diameter of the depression and having a ramped depression formed into at least a portion of a circumference of the plug for twisting engagement with the ramped thread of the socket. In other embodiments, the socket may comprise a keyed structure, such as a ring around the depression wall with one or more portions of the ring absent (i.e., notches), allowing a plug with one or more protrusions matching the size and location of the notches in the ring to extend past the ring, thereby removably locking the plug to the plug is rotated within the socket. Similarly, a bayonet-type connection could be used. The term "removably", as used herein, refers to an attachment, engagement, connection, or joining of two structures which later may be unattached, disengaged, disconnected, or disjoined, e.g., a non-permanent attachment, engagement, connection, or joining. For example, structures may be removably attached, engaged, connected, or joined to sockets during enjoyment of one or more water-based activities and unattached, disengaged, disconnected, or disjoined after the activity has concluded, allowing for use of with another water-based activity, or compact storage and transportation of watercraft 200 and related structures when all activities have been completed.

Watercraft 200 may be constructed using known techniques, such as glass-reinforced plastic construction using polyester or epoxy resin that is compatible with polyurethane or expanded polystyrene foam used in its core. Some SUP boards use a hollow wood construction instead of foam with epoxy resin. More recently, inflatable boards have been introduced as well. The boards are generally longer than 9 feet (3 m), and can be longer than 12 feet (4 m), with features such as padded decks and concave hulls; they generally have one or three surfboard-style fins mounted to the bottom surface of watercraft 200 in the tail portion. The sockets may be constructed of a different material than the rest of watercraft 200 such as hard plastic, metal, or other material capable of supporting loads imposed upon the sockets by various connecting structures.

Watercraft 200 additionally comprises covers 204, which are used to cover the sockets when watercraft 200 is used in its typical intended function. For example, if watercraft 200 is a surfboard, covers 204 may be removably engaged to the sockets so that the sockets would not interfere with use of watercraft 200 as a surfboard. Covers 204 may be removably attached to the sockets using conventional means, such as by sizing covers 204 to snap-fit with the sockets, by using threads on covers 204 and the sockets, etc. Smaller sockets may not require the use of covers 204 if they do not interfere with the use and enjoyment of watercraft 200 in its intended manner.

Figure 3:
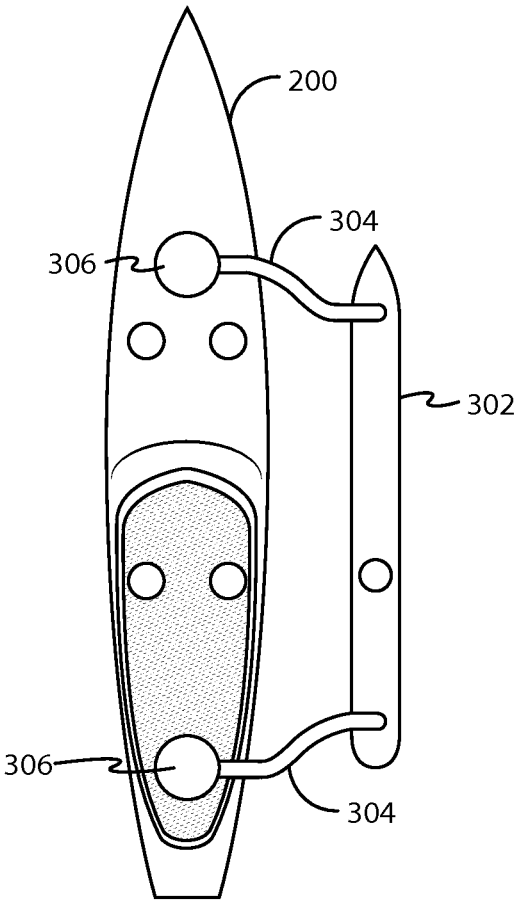
FIG. 3 is a plan view of one embodiment of a multi-use, configurable watercraft configured as an outrigger stand-up paddleboard (SUP)

FIG. 3 is a top, plan view of one embodiment of a multi-use, configurable watercraft 300, comprising watercraft 200, outrigger 302, two outrigger connecting structures 304, and footing 306. In this embodiment, watercraft 300 is configured as an outrigger SUP, the outrigger for making it easier for novice paddle boarders to learn and enjoy paddle boarding. Further, watercraft 200, in this embodiment, comprises a SUP.

As shown, watercraft 300 comprises outrigger 302 removably attached to watercraft 200 via the two outrigger connecting structures 304. The structures 304 each comprise a solid material such as wood, metal, plastic or fiberglass and, in one embodiment, comprise hollow aluminum tubes having a circular cross-section. Each of the structures 304 are removably attached to a respective one of the sockets 202*a* and 202*b* via the footings 306, more fully described below. In one embodiment, the structures 304 are additionally removably attached to outrigger 302.

Figure 4:
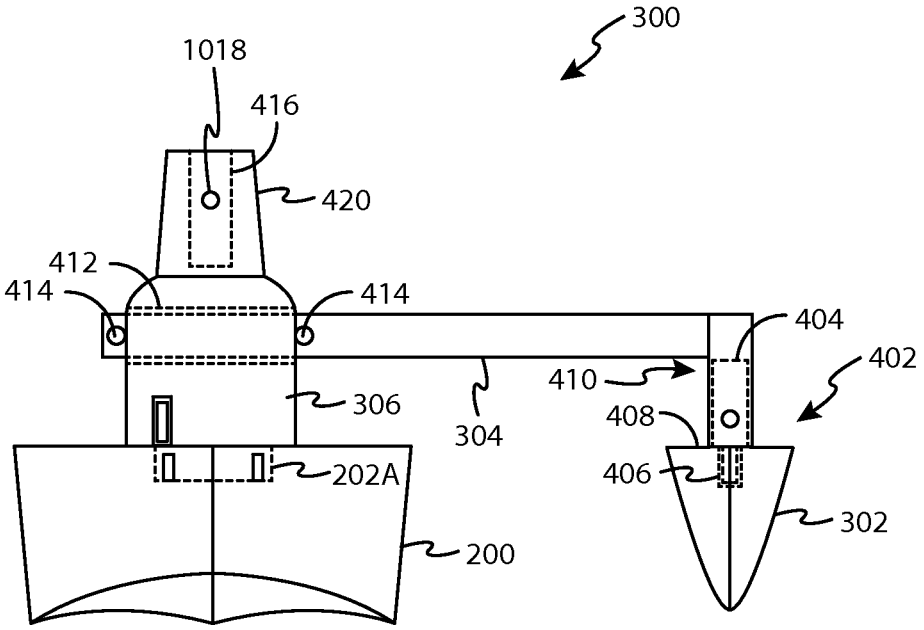
FIG. 4 is a front, plan view of the watercraft shown in FIG. 3.

FIG. 4 is a front, plan view of watercraft 300 showing watercraft 200, outrigger 302, one of the connecting structures 304 (the other is hidden behind the one shown in FIG. 4). In one embodiment, one end of the structures 304 comprises footing 306 that engages sockets 202*a* and 202*b*, respectively (only socket 202*a* shown in FIG. 4). The footing 306 may be formed as part of each structure 304 or it may be an individual component that is removably connected to structure 304 using draw latches, cotter pins, ball lock pins, and the like. In one embodiment, footing 306 comprises a hole 412 formed horizontally through the side walls of footing 306 that allows structure 304 to be inserted there though and immobilized using retaining means 414, such as cotter pins, ball lock pins, or some other fastening device. In the embodiment shown in FIG. 4, footing 306 additionally comprises a mast socket 416 formed through a mast mount 420 for receiving a mast in an application where watercraft 200 is configured as a sailboat. This embodiment is discussed in greater detail later herein.

The structures 304 may be removably connected to outrigger 302 at point 402, showing use of a small "transition tube" 404 attached to outrigger 302 by insertion into a depression 406 formed on a top surface 408 of outrigger 302 and removably securing it using, for example, a draw latch. An end portion 410 of structure 304 is then placed over the transition tube 404 and held in place by, for example, a cotter pin. In another embodiment, end portion 410 comprises a structure that removably attaches to depression 406 directly without the use of transition tube 404, for example, any of the structures discussed previously with respect to structures 304 being removably attached to sockets 202*a* and 202*b*.

In any case, footing 306 engages socket 202*a* using the twist-lock design, described above, or in any number of alternative ways, such as by using draw latch hooks formed in the wall or floor of the sockets and draw latches attached to footing 306. Alternatively, the sockets may comprise a threaded wall and footing 306 could likewise comprise threads that engage the threads on the socket wall as footing 306 is screwed into the socket. A similar footing 306 is removably attached to socket 202*b* towards the rear of watercraft 200, and a corresponding structure 304 connects this footing 306 with the outrigger 302.

Thus, in this embodiment, a stand-up paddleboard has been converted into an outrigger stand-up paddleboard using components that are removably attached to the stand-up paddleboard.

Figure 5:
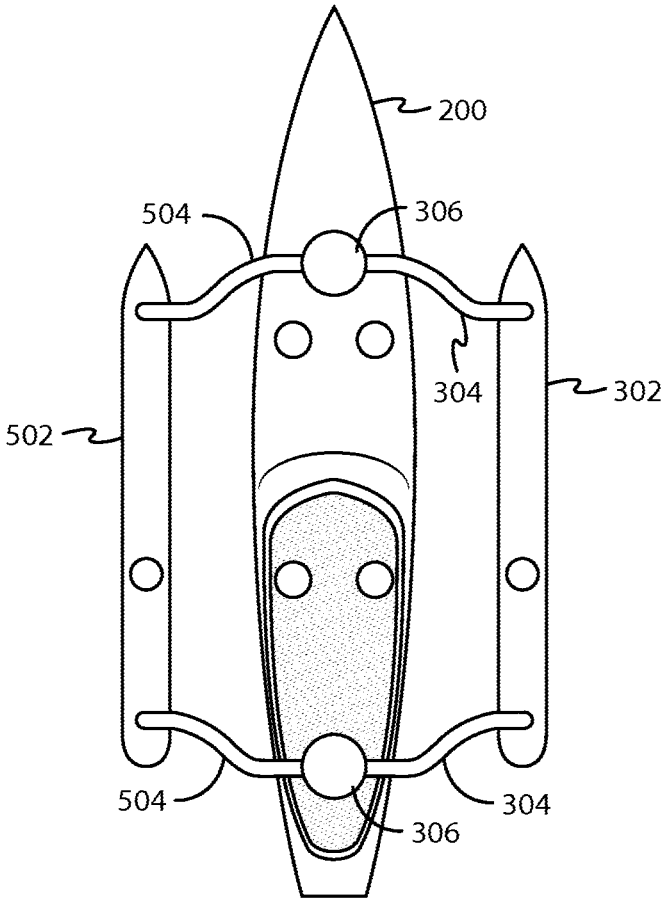
FIG. 5 is a top, plan view of the watercraft of FIG. 3, with an additional outrigger.
Figure 6:
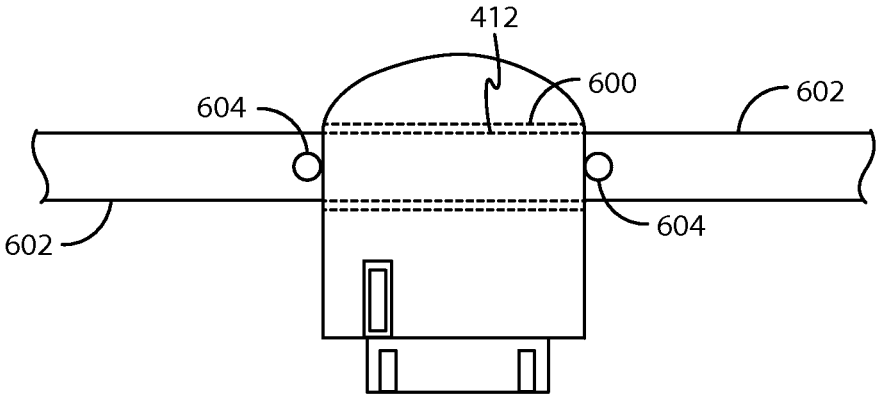
FIG. 6 is a front, plan view of the watercraft shown in FIG. 3, showing an addition of a strengthening sleeve.

FIG. 5 is a top, plan view of another type of watercraft 500 formed from watercraft 200 and having two outriggers 302 for extra stability. This embodiment is similar to watercraft 300 described above, with the addition of a second outrigger 502 and second connecting structures 504, similar to, or the same as, outrigger 302 and connecting structures 304. The second connecting structures 504 may be attached to watercraft 200 in a manner similar to what was described above with respect to how connecting structures 304 were removably attached to watercraft 200. In one embodiment, each of the connecting structures 304 and 504 are formed of a single unit, passing through hole 412 in each footing 306 and secured in place using clamps, cotter pins, etc. In one embodiment, shown in FIG. 6, a strengthening sleeve 600 may be used to add additional strength and stability to the structures 304 and 504, whether these structures are formed as a single unit or not. FIG. 6 is a side, plan view of footing 306 (without mast socket) having a single connecting structure 602 (instead of connecting structures 304 and 504) connecting each outrigger 302 and 304, respectively, inserted into hole 412 inside sleeve 600. Sleeve 600 is generally formed of a rigid or semi-rigid material having a cross-section generally matching the cross section of hole 412, while having an inside diameter that corresponds to an outer diameter of connecting structure 602. As mentioned previously, structure 602 may be held in place using fastening devices such as cotter pins, screws, nuts/bolts, ball lock pins, etc. through holes 604 formed through sleeve 600 and structure 602.

Figure 7:
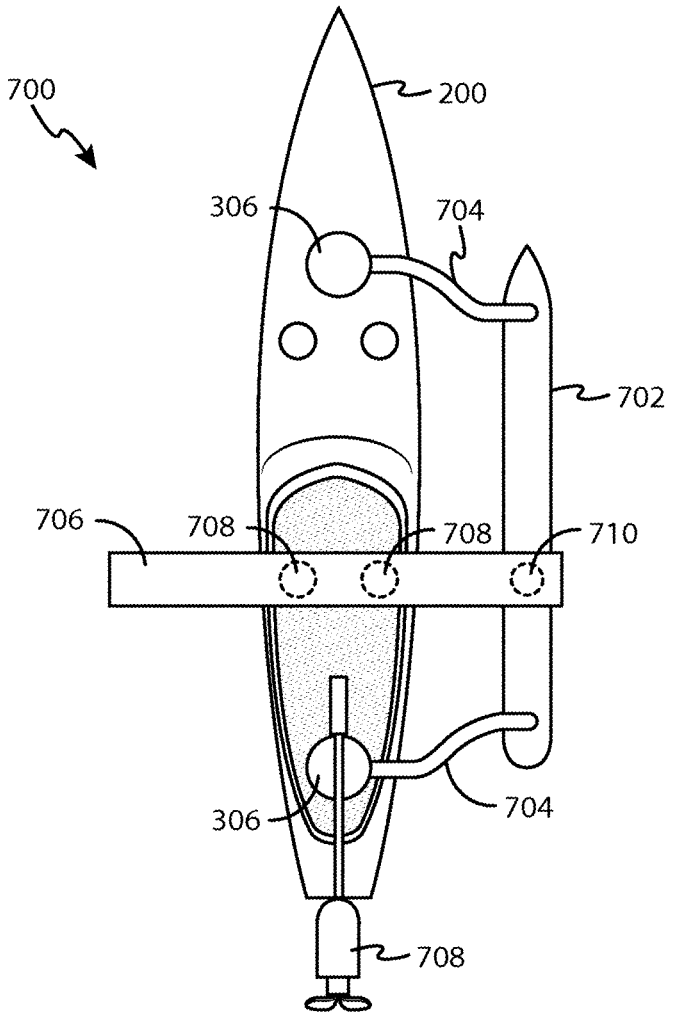
FIG. 7 is a top, plan view of another embodiment of a multi-use, configurable watercraft configured as a motorboat.

FIG. 7 is a top, plan view of another type of watercraft 700 formed from watercraft 200 and having one outrigger 702, two connecting structures 704, a seating bench 706, and a motor 708. In this embodiment, watercraft 700 comprises a motorboat.

Outrigger 702 is removably attached to watercraft 200 using footing 306 discussed previously with respect to FIGS. 2-6. Bench 706 is removably attached to watercraft 200 and outrigger 702 using any of the techniques discussed above in relation to attaching footing 306 to sockets 202*a* and 202*b*. In this embodiment, two sockets 708 are formed into a top surface of watercraft 200 and an additional socket 710 formed into a top surface of outrigger 702. The bench may be removably attached to watercraft 200 and outrigger 702 via footings similar to footing 306 described above inserted into one or more of the sockets 708 and socket 710, or by using other structures, such as those shown in FIG. 8.

Figure 8:
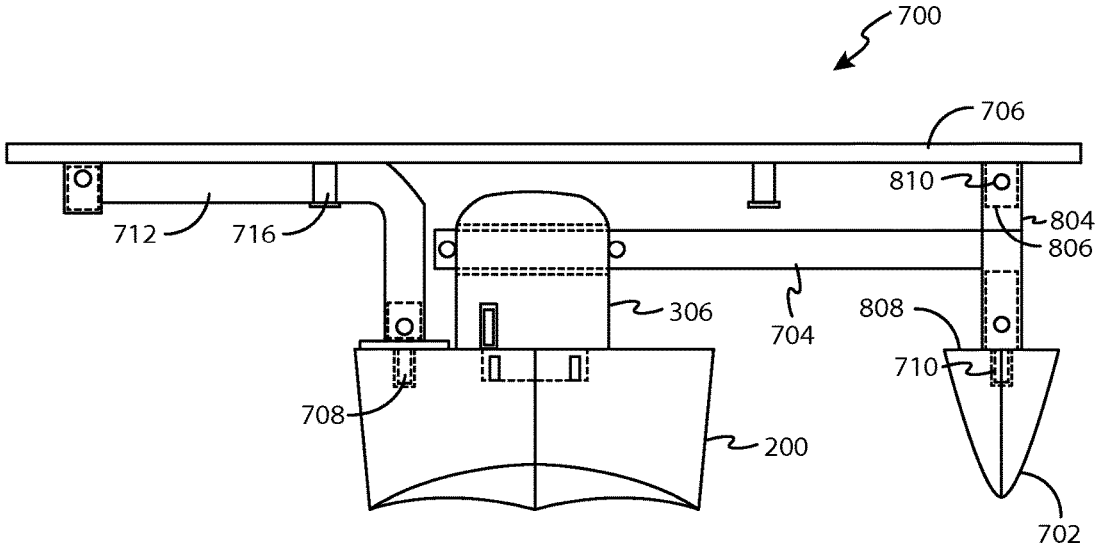
FIG. 8 is a front, plan view of the watercraft shown in FIG. 3, showing a seating bench.

FIG. 8 is similar to FIG. 4 in that it shows a front, plan view of watercraft 700 showing watercraft 200, outrigger 702, and one of the connecting structures 704. FIG. 8 further shows bench 706 removably attached to watercraft 200 via bench supporting structure 712, bench supporting structure 714, clamp 716, and sockets 708 and 710. Bench supporting structure 712 comprises a rigid member, shown in FIG. 8 as an "L"-shaped structure having one end removably attached to watercraft 200 via socket 708, and bench 706 attached to bench supporting structure 712 using one or more clamps 800. In other embodiments, bench supporting structure could comprise any number of different physical configurations and be attached to bench 706 using other types of fasteners, such as pins, screws, nuts and bolts, rivets, etc. Bench 706 is removably secured to socket 708 using one of the techniques discussed above, such as by the use of transition fitting 802.

Bench supporting structure 714 comprises a semi-hollow support structure 804 that extends upwards from connecting structure 704 to receive a protrusion 806 mounted to an underside of bench 706. The structures may be held in place with respect to each other using, for example, a cotter, ball lock pin, pin or other type of temporary securing mechanism 810. In another embodiment, protrusion 806 is longer than that shown in FIG. 8, and is inserted directly a socket similar to socket 710 on top surface 808 of outrigger 702. In another embodiment, protrusion 806 simply rests on top of connecting structure 704 or outrigger 702.

Referring back to FIG. 7, watercraft 700 further comprises motor 708, comprising a gasoline, diesel, or electric outboard motor. Motor 708 is used to propel watercraft 700 through water. It may be sized in accordance with the size and/or weight of watercraft 700. A typical motor may be sized in horsepower or kilowatts and a typical motor size may vary from low-power "trolling" motors to more powerful motors capable of propelling watercraft 700 to speeds of 30 knots or more.

Figure 9:
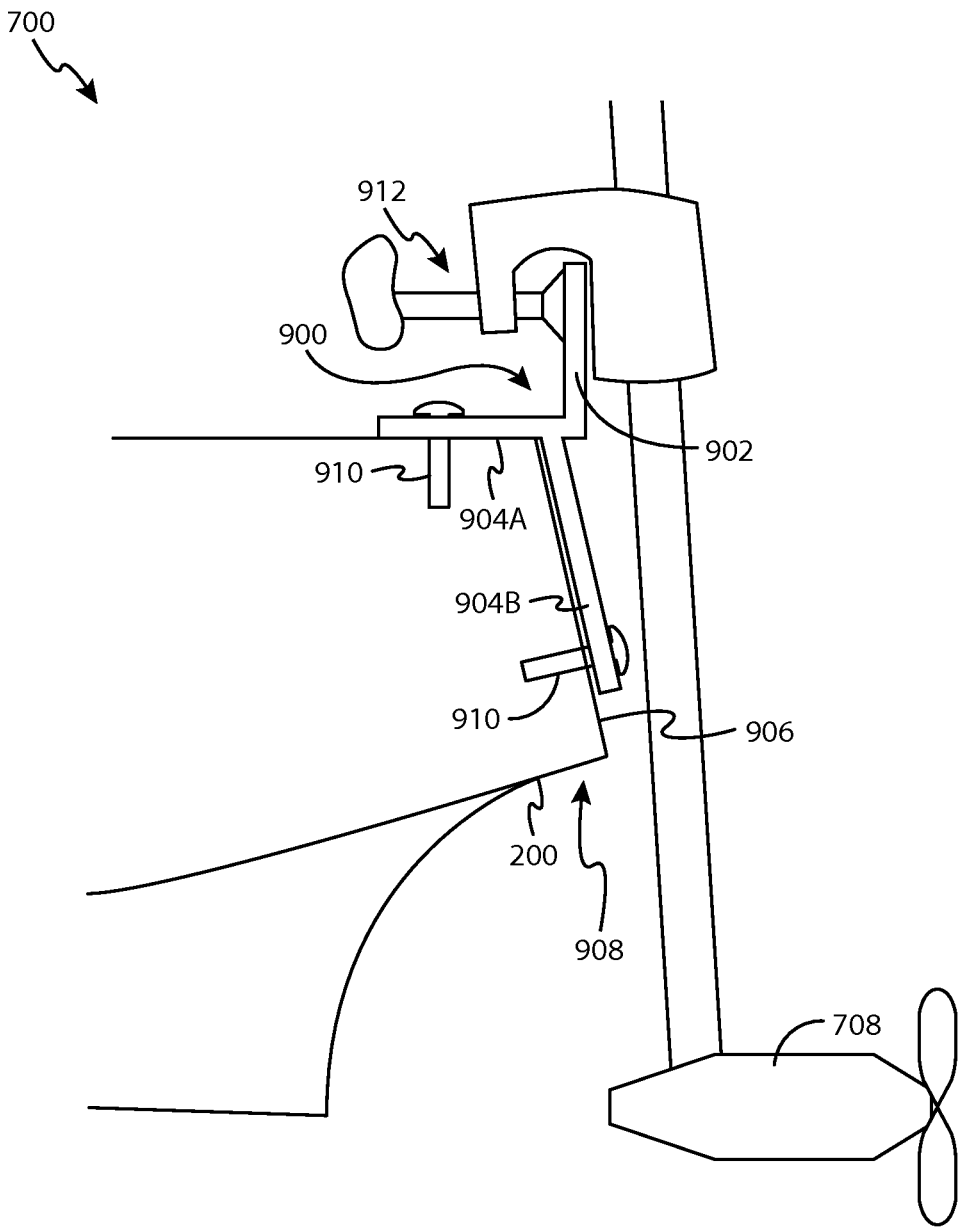
FIG. 9 is a side view of a motor removably attached to the watercraft of FIG. 1.

FIG. 9 is a side view of motor 708 removably attached to watercraft 700 via a removable motor transom 900. Motor transom 900 comprises a rigid structure comprising a vertical section 902 and one or more mounting sections 904. In FIG. 9, two mounting sections are shown, sections 904*a* and 904*b*. Each of these sections is secured to a corresponding surface of watercraft 700. In FIG. 9, section 904*a* is removably attached to top surface 104, while section 904*b* is removably attached to transom 906 of tail portion 908 of watercraft 700. In other embodiments, only one of section 904*a* or 904*b* may be used to removably secure motor transom 900 to tail portion 908. The sections 904*a* and/or 904*b* may be removably secured to top surface 104/transom 906 using screws, bolts, ball lock pins, twist locks, cam locks, or other fasteners 910 that allow motor transom 900 to be quickly attached and removed from watercraft 700.

Motor 708 is removably attached to motor transom 900 using a clamping mechanism 912 as shown in FIG. 9. Clamping mechanism could, alternatively, take many forms, including one or more of nuts and bolts, cam locks, etc.

Figure 10:
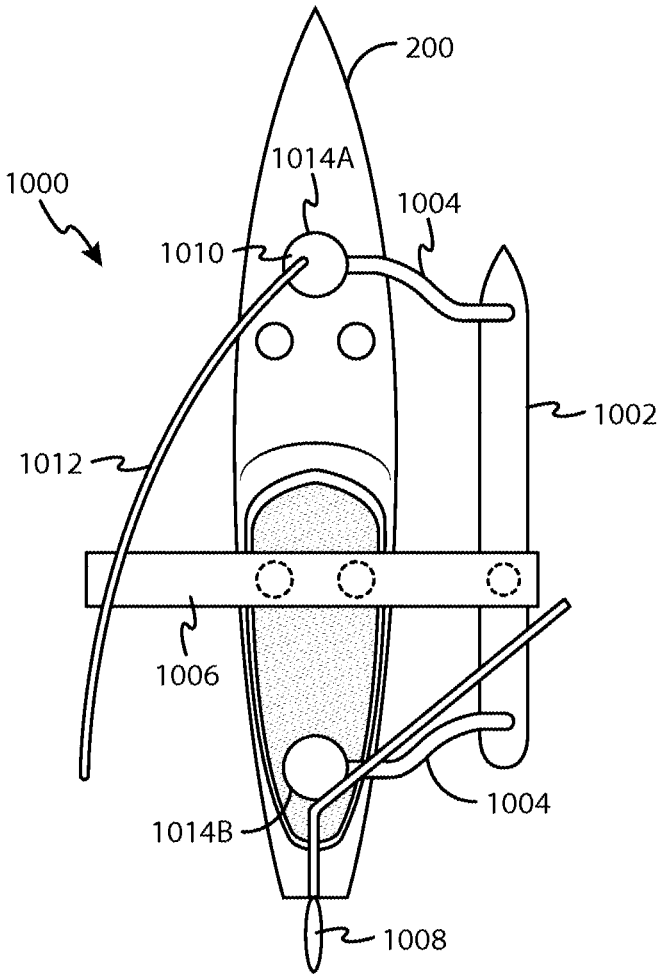
FIG. 10 is a top, plan view of another embodiment of a multi-use, configurable watercraft configured as a sailboat.

FIG. 10 is a top, plan view of yet another type of watercraft 1000 formed from watercraft 200 and having one outrigger 1002, two connecting structures 1004, a seating bench 1006, a rudder 1008, a mast 1010, and a sail 1012. In this embodiment, watercraft 1000 comprises a sailboat. Watercraft 1000 could, alternatively, comprise a second outrigger, such as the second outrigger shown in FIG. 5, to add further stability to watercraft 1000. Outrigger 1002, connecting structures 1004, and seating bench 1006 are removably attached to watercraft 200 in a similar manner as described earlier.

In this embodiment, footing 1014*a* and 1014*b* (similar to footing 306 described in FIG. 4) comprises the necessary structure to attach to connecting structures 1004 (e.g., the structure shown in FIGS. 4 and 6, but the "fore" footing 1014*a* additionally comprises a mast socket 1016 formed the top of footing 1014, sized and shaped to receive a mast, as shown in FIG. 4. A typical mast for use in a sailing application may comprise a mast height of 15 feet and a circular mast diameter of 6 inches. Thus, the diameter and cross-section of mast socket 1016 would be approximately the size and cross-section of the mast. The mast is typically removably secured in place using retaining means, such as a cotter pin, cam lock, ball lock pin, etc., placed through a retaining hole 1018 in footing 1014*a* and a corresponding hole through mast 1010. Sail 1012 may then be deployed from the mast for propelling watercraft 1000 through the water.

Figure 11:
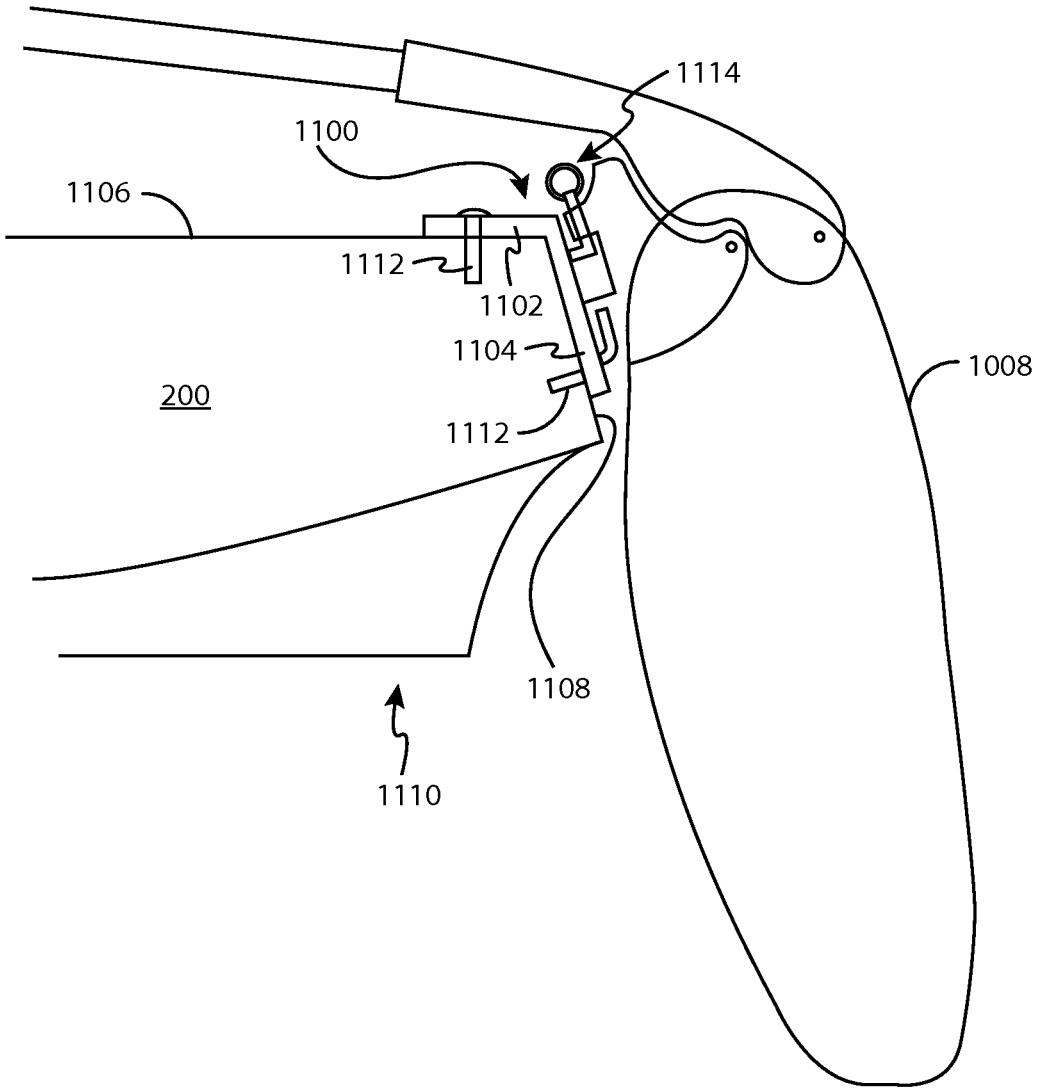
FIG. 11 is a side view of a rudder assembly removably attached to the watercraft of FIG. 1.

Rudder 1008 is used to steer watercraft 1000 in a sailing application and is shown in one embodiment in a side, plan view in FIG. 11. Rudder 1008 is removably attached to watercraft 1000 via a removable rudder transom 1100. Rudder transom 1100 comprises a rigid structure comprising one or more mounting sections, shown as two mounting sections 1102 and 1104. Each of these sections is secured to a corresponding surface of watercraft 200. In FIG. 11, section 1102 is removably attached to top surface 1106 of watercraft 200, while section 1104 is removably attached to transom 1108 of tail portion 1110 of watercraft 200. In other embodiments, only one of section 1102 or 1104 is used to removably secure rudder transom 1100 to transom 1108. The sections 1102 and/or 1104 may be removably secured to top surface 1106/transom 1108 using screws, bolts, ball lock pins, twist locks, cam locks, or other fasteners 1112 that allow rudder transom 1100 to be quickly attached and removed from watercraft 200.

Rudder 1108 may then be attached to rudder transom 1100 using, in one embodiment, a clamping device 1114 that removably clamps rudder 1108 to rudder transom 1100, as shown. Other means for securing rudder 1108 to rudder transom 1100 may be used in the alternative, such as one or more of nuts and bolts, cam locks, ball lock pins, etc.

Figure 12:
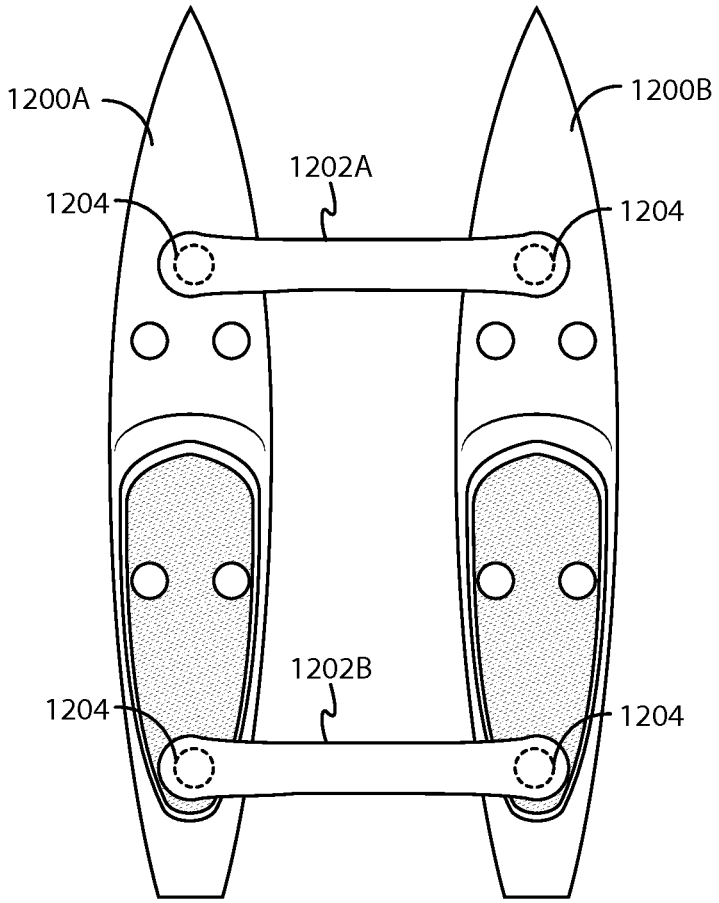
FIG. 12 is a top, plan view of yet another embodiment of a multi-use, configurable watercraft configured as a double stand-up paddleboard.

FIG. 12 is a top, plan view of still yet another type of watercraft 1200 formed from a combination of two watercraft 200*s* (1200*a* and 1200*b*) and two cross-members 1202*a* and 1202*b* to form a double stand-up paddleboard for two or more people. Each watercraft 200 comprises two sockets 1204, one fore and one aft, for removably attaching a respective cross-member 1202. The cross-members comprise a rigid structure for removably connecting watercraft 1200*a* to watercraft 1200*b*, better shown in FIG. 13. In some embodiments, watercraft 200*a*, 200*b*, or both may additionally comprise other sockets used to install one or more connecting structures/outriggers, kayak seats, seating benches, or other ancillary equipment, as discussed previously.

Figure 13:
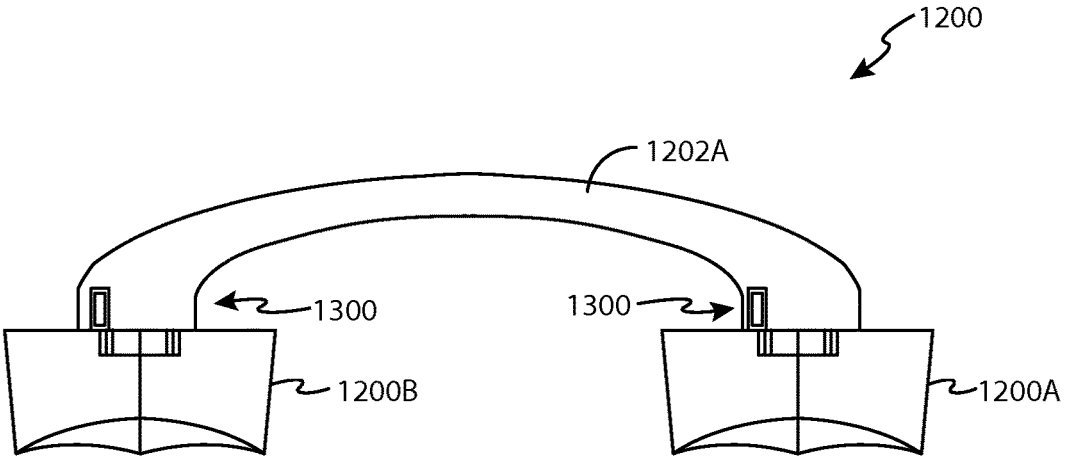
FIG. 13 is a front, plan view of a cross-member used in the embodiment of FIG. 12 and other embodiments.

In FIG. 13, the "fore" cross-member 1202*a* is shown from a front, plan view of watercraft 1200 mounted to watercraft 1200*a* and watercraft 1200*b*. In this embodiment, cross-member 1202*a* comprises a "bowed", rigid member having two ends, each end having a footing 1300 formed or attached thereto, although cross-member 1202*a* may comprise a number of alternative shapes. The footings 1300 are similar in design and function as footings 306 discussed earlier herein.

Figure 14:
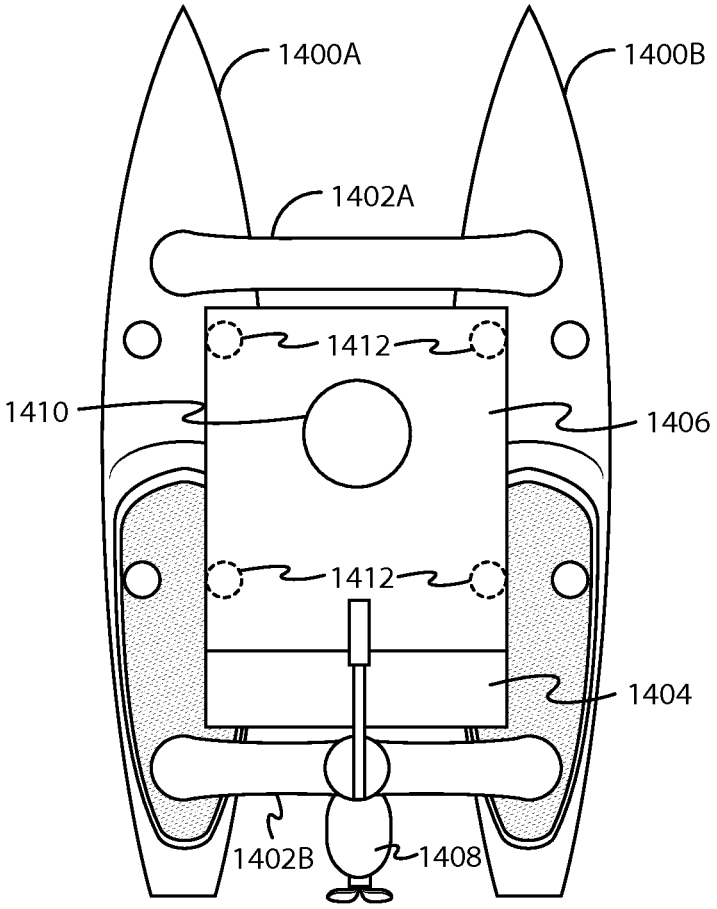
FIG. 14 is a top, plan view of still yet another embodiment of a multi-use, configurable watercraft configured as a dual-hull motorboat.

FIG. 14 is a top, plan view of still yet another type of watercraft 1200 formed from a combination of two watercraft 200*s* (1400*a* and 1400*b*), two cross-members 1402*a* and 1402*b*, a seating bench 1404, a deck 1406, and a motor 1408 to form a dual-hull motorboat. The watercraft 1400*a* and 1400*b* are removably joined by cross-members 1402*a* and 1402*b*, as described above with respect to the description of FIGS. 12 and 13. Bench 1404 is the same or similar to bench 706 and is mounted to watercrafts 1400*a* and 1400*b* in much the same way as described with respect to the description relating to FIGS. 7 and 8. Deck 1406 is used to further removably secure watercrafts 1400*a* and 1400*b* to each other using fastening devices located at various points on deck 1406 that cover a top surface of watercrafts 1400*a* and 1400*b*, such as ball lock pins, cam locks, bolts, or other known fastening devices engaged with sockets 1412 located at various points on the top surface of each of watercrafts 1400*a* and 1400*b*. Each of these sockets 1412 may comprise threaded holes or inserts located in alignment with through holes or threaded holes located through deck 1406 in order to achieve such removable attachment. Deck 1406 comprises any rigid or flexible material including, but not limited to, canvas, netting, plastic, metal, or wood. Finally, deck 1406 may comprise a "fishing seat" 1410 formed through deck 1406, comprising a harness or a seat located beneath the upper surface of deck 1406, enabling an individual to sit.

Figure 14A:
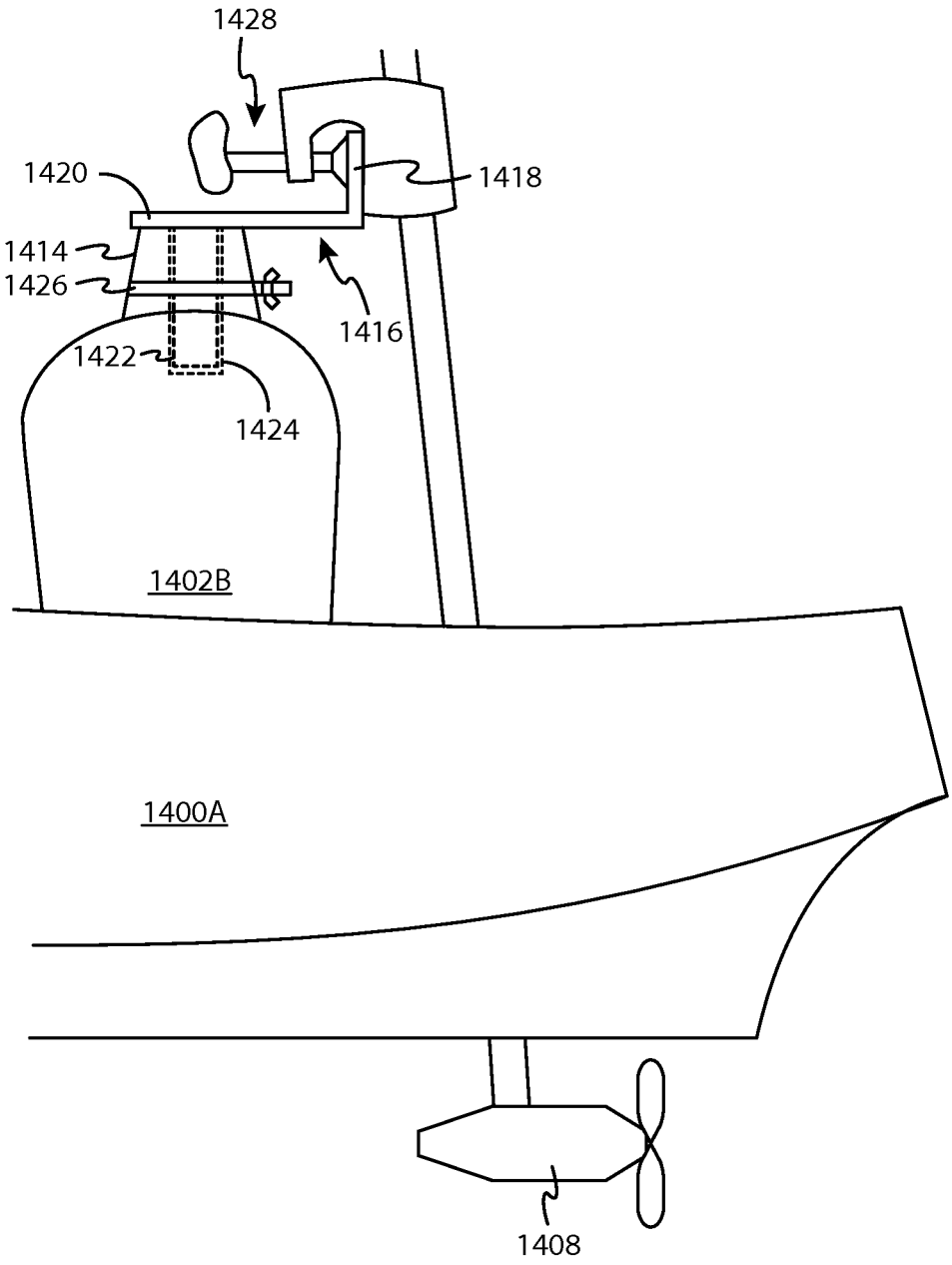
FIG. 14*a* is one embodiment of a side, plan view a motor removably attached to the watercraft shown in FIG. 14.

FIG. 14*a* is one embodiment of a side, plan view of motor 1408 removably attached to watercraft 700 via a motor transom 1416 mounted to a motor mounting structure 1414 that is mounted to, or formed part of, cross-member 1402*b*. In another embodiment, motor mounting structure 1414 is not used, and motor transom 1416 is mounted to a hole formed in the top of cross-member 1402*b*. In one embodiment, motor transom 1416 is similar to the motor transom shown in FIG. 9, e.g., motor transom 1416 comprises a rigid structure comprising a vertical section 1418. Motor transom 1416 further comprises a horizontal plate 1420 connected to vertical section 1418 which in turn comprises insert 1422 that is sized and shaped to be inserted into hole 1424. Hole 1424 may extend into cross-member 1402*b* as shown. Insert 1422 and motor mounting structure may be prevented from rotating with respect to each other via a ball lock pin, clamp, bolt, or other fastening device 1426. In another embodiment, both insert 1422 and hole 1424 comprise a cross-section having at least one acute angle, such as a triangular, or square cross-section, that prevents rotation of insert 1422 within hole 1424.

Motor 1408 is removably attached to motor transom 1416 using a clamping mechanism 1428 as shown in FIG. 14*a*. Clamping mechanism could, alternatively, take many forms, including one or more of nuts and bolts, cam locks, etc.

Figure 15:
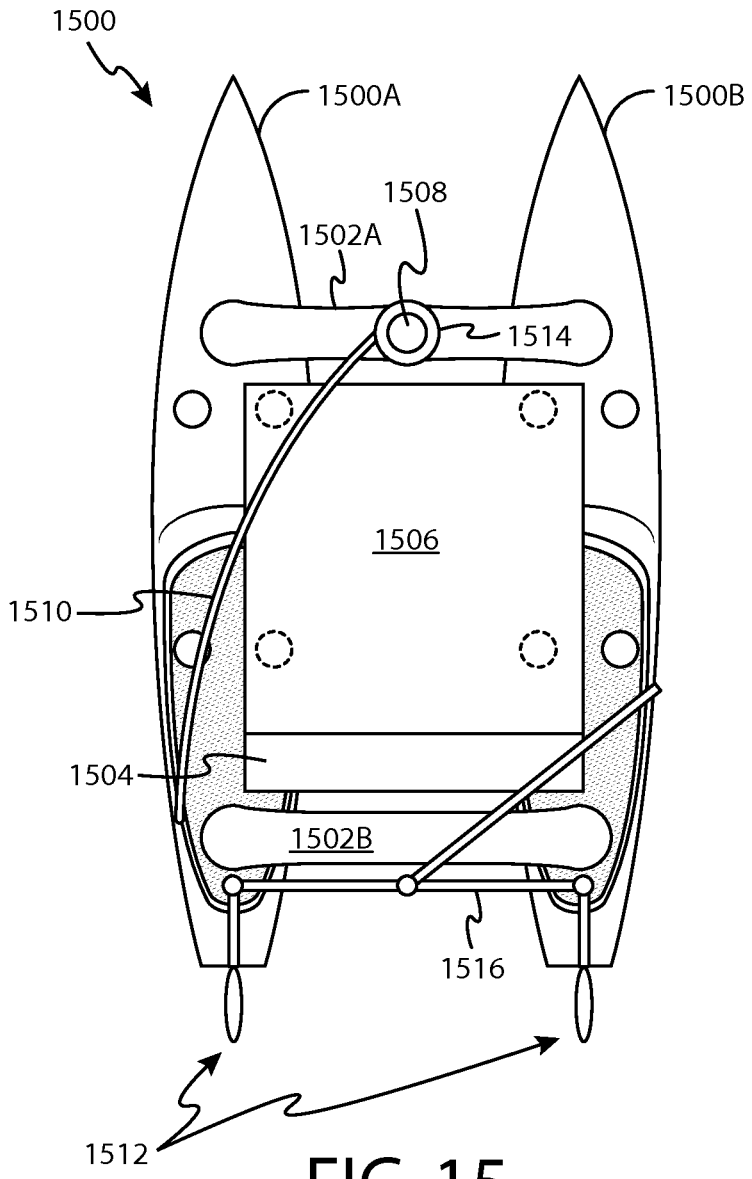
FIG. 15 is a top, plan view of still yet another embodiment of a multi-use, configurable watercraft configured as a dual-hull sailboat.

FIG. 15 is a top, plan view of still yet another type of watercraft 1500 formed from a combination of two watercraft 200*s* (1500*a* and 1500*b*), two cross-members 1502*a* and 1502*b*, a seating bench 1504, a deck 1506, a mast 1508, a sail 1510, and a rudder assembly 1512, forming a dual-hull sailboat. The two watercraft 1500*a* and 1500*b*, cross-members 1502*a* and 1502*b* (including mast socket 1514), seating bench 1504, deck 1506, mast 1508, and sail 1510 are similar or the same as like-referenced structures that have been described previously with respect to other embodiments.

With regard to rudder assembly 1512, it comprises two of the rudder structures shown in FIG. 11 and described above, one each mounted to a tail section of each watercraft 1500*a* and 1500*b*. The rudders themselves are connected via a linkage 1516, which allows the rudders to turn in tandem with each other as the linkage is manipulated by a sailor.

Figure 16:
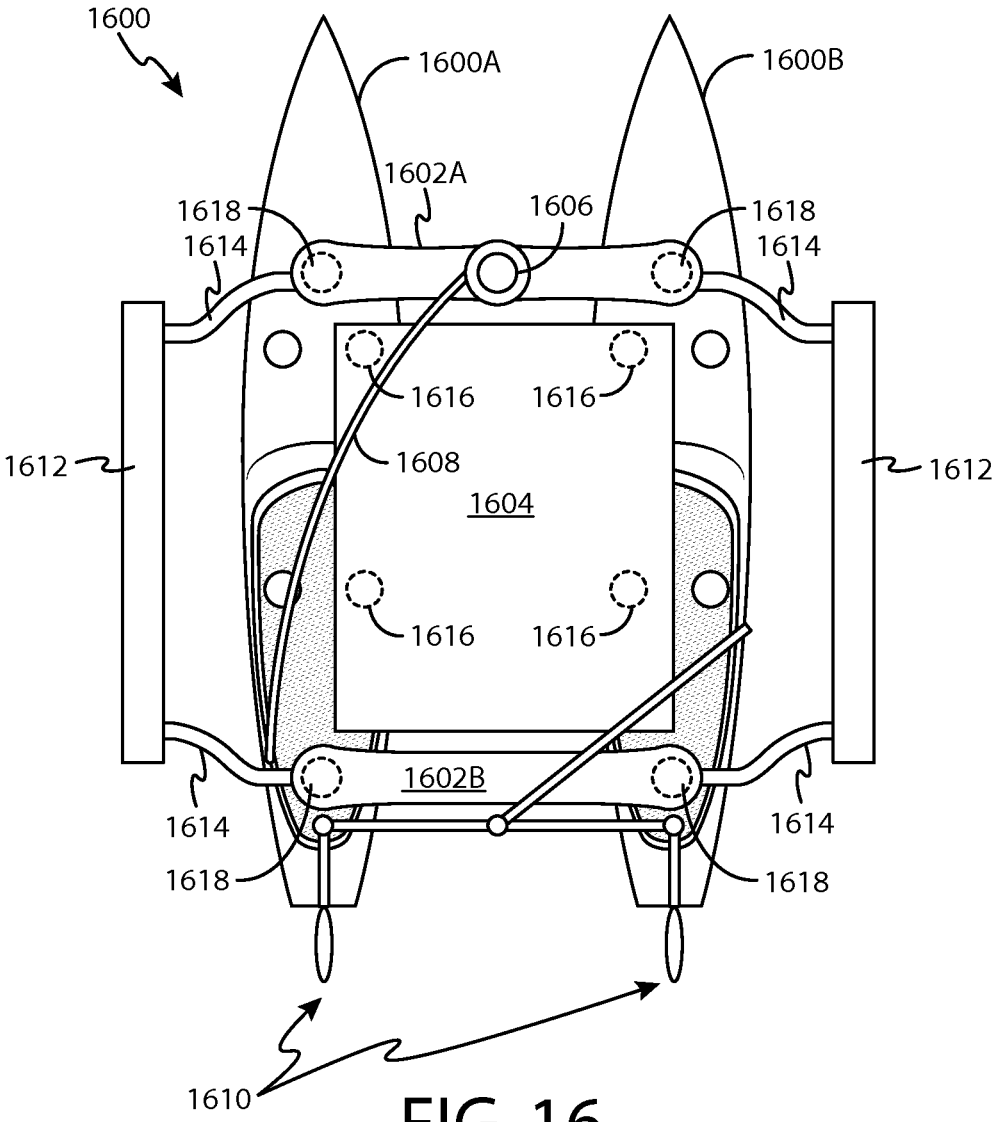
FIG. 16 is a top, plan view of still yet another embodiment of a multi-use, configurable watercraft configured as a Hobie Cat®.

FIG. 16 is a top, plan view of still yet another type of watercraft 1600, similar to the sailboat described with respect to FIG. 15, formed from a combination of two watercraft 200*s* (1600*a* and 1600*b*), two cross-members 1602*a* and 1602*b*, a trampoline 1604, a mast 1606, a sail 1608, a rudder assembly 1610, at least one seating bench 1612 (two are shown in FIG. 16), and connecting structures 1614 forming what is commonly known as a catamaran. One well-known brand of catamarans is Hobie Cat®, manufactured by the Hobie Cat Company of Oceanside, Calif. The two watercraft 1600*a* and 1600*b*, cross-members 1602*a* and 1602*b* (including a mast socket), mast 1606, sail 1608 are similar or the same as like-referenced structures that have been described previously with respect to other embodiments.

In one embodiment, trampoline 1604 is similar to deck 1406 and 1506 in that it is removably connected to the top surface of each of the watercrafts 1600*a* and 1600*b* via temporary fasteners such as cam locks, twist-locks, bolts, screws, etc. inserted through holes in deck 1604 and into sockets 1616 formed on the top surfaces. However, trampoline 1604 typically comprises a flexible material, such as nylon, cotton, or other natural or man-made fabric, forming a solid sheet or meshed netting. In another embodiment, trampoline 1604 is, alternatively or in addition, removably attached to one or both cross-members 1602*a* and 1602*b*. Trampoline 1604 is used by sailors and passengers to sit or lay down on watercraft 1600, while allowing control over sail 1608 and rudder assembly 1610.

Finally, watercraft 1600 may comprise one or more optional seating benches 1612. The seating bench(es) are generally rigid longitudinal members that are removably connected to the watercraft 1600*a* and/or 1600*b* via connecting structures 1614 and a footing 1618 similar or the same as footing 306 shown in FIG. 4 and described above. Bench(es) 1612 allow catamaran participants to sit out over the water and enjoy operating watercraft 1600 as one watercraft 200*a* or 200*b* rises out of the water during high-speed catamaraning.

Figure 17:
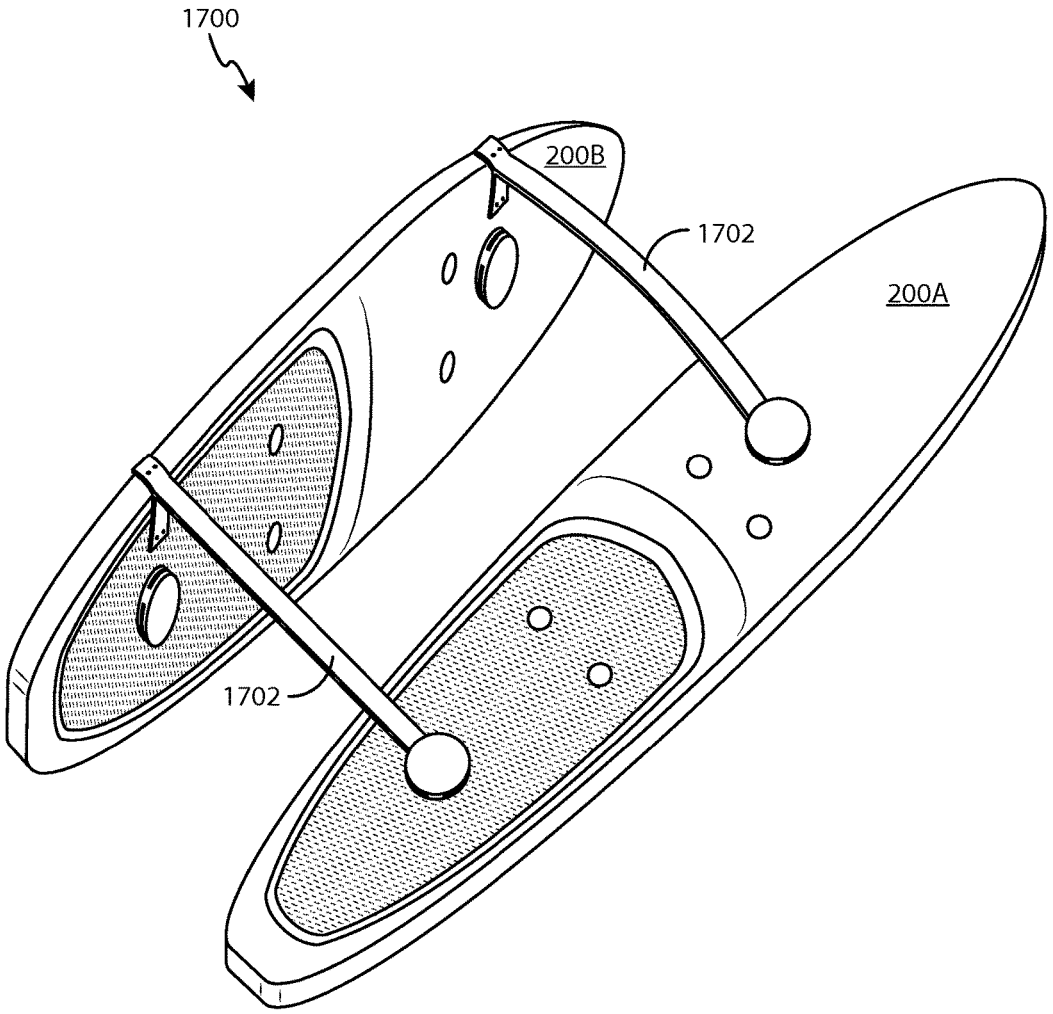
FIG. 17 is a perspective view of yet another embodiment of a multi-use, configurable watercraft configured as outrigger kayak, canoe, or other vessel, using the watercraft of FIG. 2 as an outrigger, rotated about its longitudinal axis.

FIG. 17 is a perspective view of still yet another type of watercraft 1700 that is similar to any watercraft embodiment that uses one or more outriggers. Shown are watercraft 200*a*, a second watercraft 200*b*, and connecting structures 1702. In this embodiment, a second watercraft 200*b* is of the same or similar watercraft type as watercraft 200*a* (i.e., paddleboard, SUP, surfboard, etc.), rotated substantially perpendicularly, i.e., approximately 90 degrees, around a longitudinal axis from its usual flat position on the water, is used as an outrigger. The advantage of using a second watercraft 200 as an outrigger is that there is no need to store and transport an outrigger that is only used in one type of water-based activity. For example, if a couple wanted to both paddleboard in the morning and kayak, canoe, sail, or motor on one watercraft together in the afternoon with an outrigger for additional stability, the second watercraft 200 can be used as the outrigger so that a dedicated outrigger need not be used.

The second watercraft 200*b* may be the same size as watercraft 200*a*, or it may be smaller. For example, watercraft 200*a* may be 12 feet long and 28 inches wide at its widest point, while watercraft 200*b* may be only 8 feet long and 20 inches wide at its widest point. Second watercraft 200*b* need not comprise sockets on its top surface in this embodiment, but is removably attached to connecting structures in a manner discussed below.

Watercraft 200*b* may be rotated either way with respect to watercraft 200*a*. In other words, a top surface of watercraft 200*b*, e.g., where a participant stands during paddle boarding or surfing, for example, may either face watercraft 200*a* or may face away from watercraft 200*a*. However, in one embodiment, the orientation of watercraft 200*b* depends on whether the front portion of watercraft 200*b* is sloped, or curved, as many such paddleboards, SUPs, and surfboards are. If such a slope exists, it may be advantageous to have the top surface of watercraft 200*b* face the top surface of watercraft 200*a*, as the sloped surface tends to push the front end of watercraft 200*b* towards watercraft 200*a* rather than the alternative, which may tend to pull watercraft 200*b* from watercraft 200*a*, thus potentially damaging watercraft 1700.

Connecting structures 1702 may be configured in any of the ways previously discussed for removable attachment with watercraft 200*a* (such as by direct connection or by use of a footing), while the opposite end of connecting structures 1702 comprise a structure that allows removable attachment to watercraft 200*b* in its rotated state.

Figure 18:
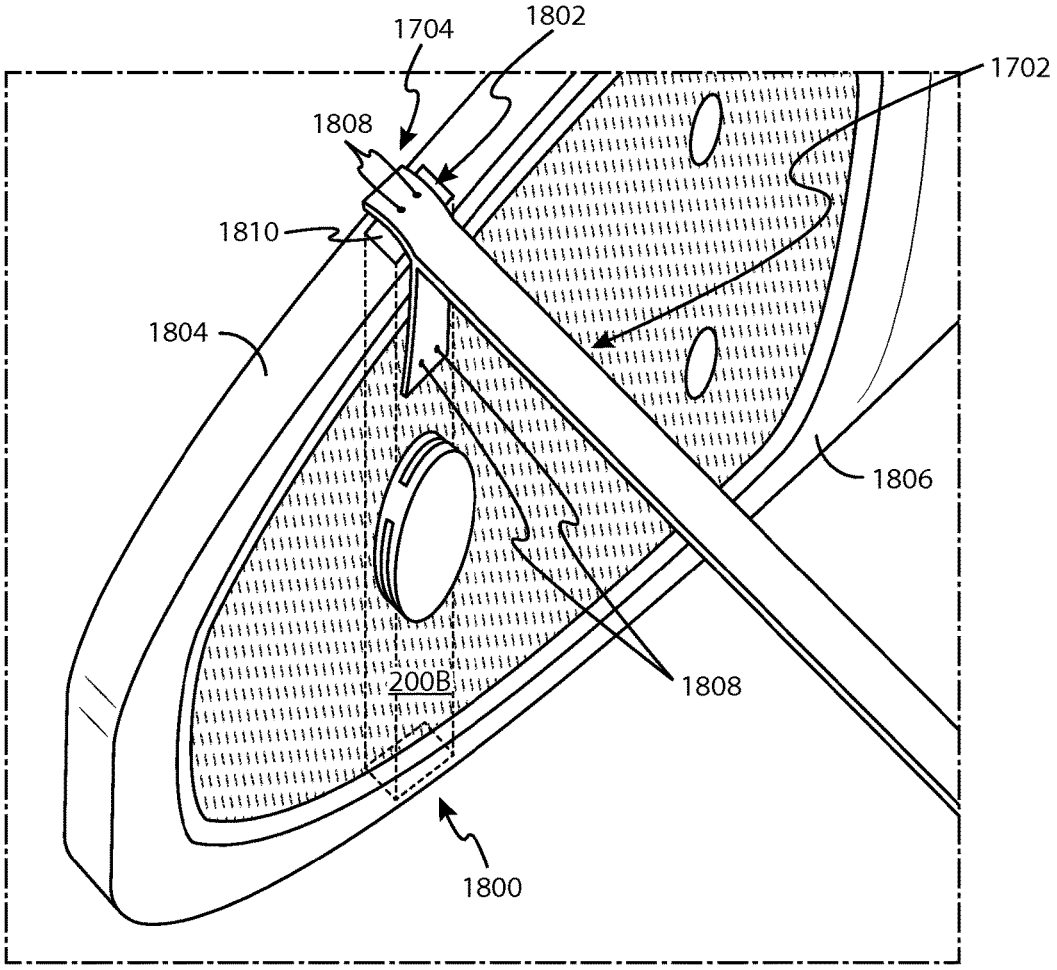
FIG. 18 is a perspective view of one embodiment of a tail section of the watercraft shown in FIG. 17 highlighting one end of a connecting structure used to removably attach the connecting structure to the watercraft shown in FIG. 17.

FIG. 18 is a perspective view of one embodiment of a tail section 1800 of a partial watercraft 200*b* and one end of connecting structure 1702, used to removably attach connecting structure 1702 to watercraft 200*b* as it lies in a rotated orientation. Shown are watercraft 200*b*, cross-member 1702, and attachment section 1802. Attachment section 1802 comprises a rigid structure that generally conforms to the sloped surfaces commonly found on rail 1804 and top surface 1806 of watercraft 200*b*, as shown. Attachment section 1802 is attached to watercraft 200 using conventional screws, bolts, nuts, cam locks, twist-lock hardware, or other non-permanent attachment hardware. In this embodiment, holes 1808 are formed through attachment section 1802, allowing such non-permanent hardware to pass. Watercraft 200*b* may have metal or plastic inserts formed into top surface 1806 to receive the non-permanent hardware. The inserts may be threaded, keyed, cammed, or otherwise fashioned to receive fastening hardware used to removably secure attachment section 1802 to watercraft 200*b*. Alternatively, watercraft 200*b* may comprise insert 1810, which is a rigid member formed within watercraft 200*b* to provide a strong base for the non-permanent hardware to be attached to. Insert 1810 may be constructed of metal, wood, plastic, or virtually any other material that can maintain the non-permanent hardware under loads encountered during use of watercraft 1700. In one embodiment, insert 1810 comprises recesses for receiving the non-permanent hardware, such as threaded holes, twist-lock hardware, or simply through holes that allow, for example, a bolt to pass.

Figure 19:
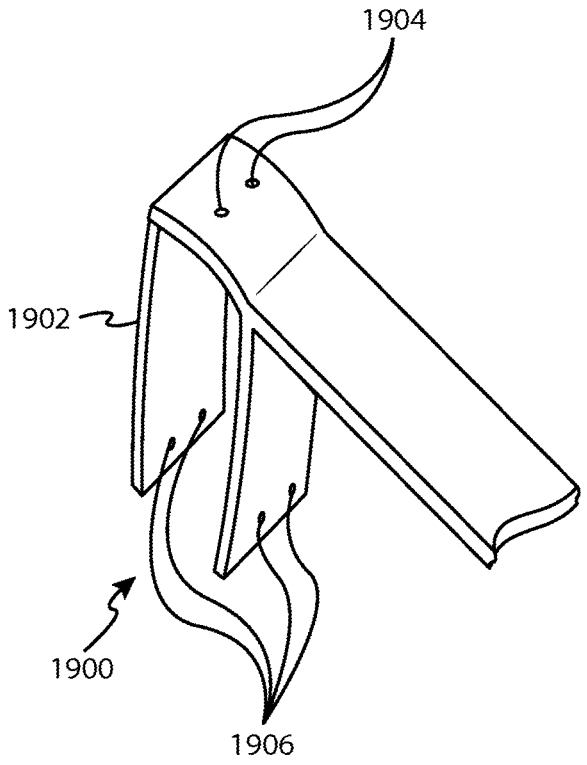
FIG. 19 is a perspective view of another embodiment of the attachment section shown in FIG. 18.

FIG. 19 is a perspective view of another embodiment of attachment section 1802, shown as attachment section 1900. In this embodiment, an extra reinforcement piece 1902 is added to the structure shown in FIG. 18, thus "sandwiching" rail 1804 of watercraft 200*b* therein. Attachment section 1900 may then be removably attached to watercraft 200*b* in any of the ways discussed above. In this embodiment, it may not be necessary to include holes 1904, as reinforcement piece 1902 adds a large degree of structural support to attachment section 1802. Thus, attachment section 1802 may be secured simply by using the holes 1906 and related non-permanent hardware.

Figure 20:
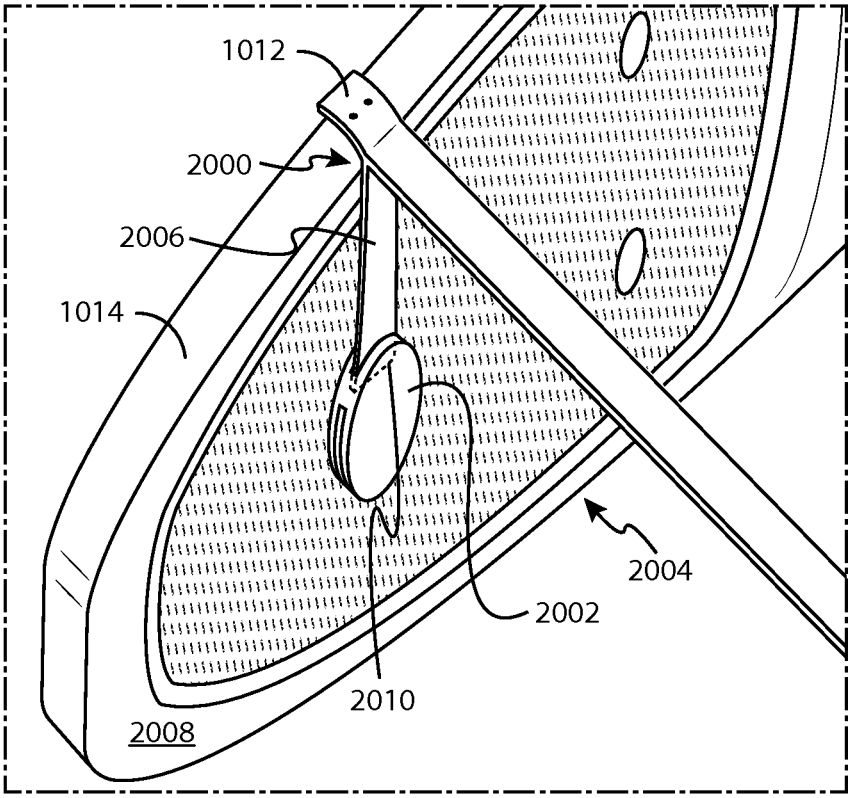
FIG. 20 is a perspective view of yet another embodiment of the attachment section shown in FIG. 18, used in conjunction with a special footing.

FIG. 20 is a perspective view of yet another embodiment of attachment section 1802, shown as attachment section 2000, used in conjunction with a special footing 2002. The attachment section 2000 is shown as attached to a partial view of watercraft 200*b* towards a tail section 2004. In this embodiment, no hardware is needed to secure top member 2006 of attachment section 2000 to top surface 2008. Rather, an end portion 2010, shown in dashed lines, is inserted into a slot formed in footing 2002 during placement of attachment section 2000 to watercraft 200*b*. After insertion a rail section 1012 may be attached to rail 1014, or the reinforcement piece 1902 may be used to add additional strength and support. The slot prevents end portion 2010, and thus top member 2006, from rising away from top surface 2008, or from otherwise moving laterally on top surface 2008.

Figure 21:
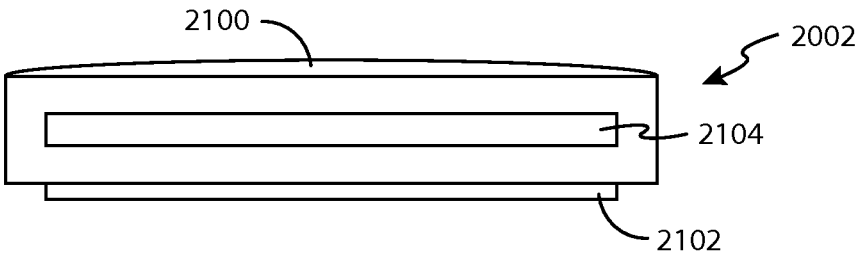
FIG. 21 is a perspective view of the special footing shown in FIG. 20.
Figure 22:
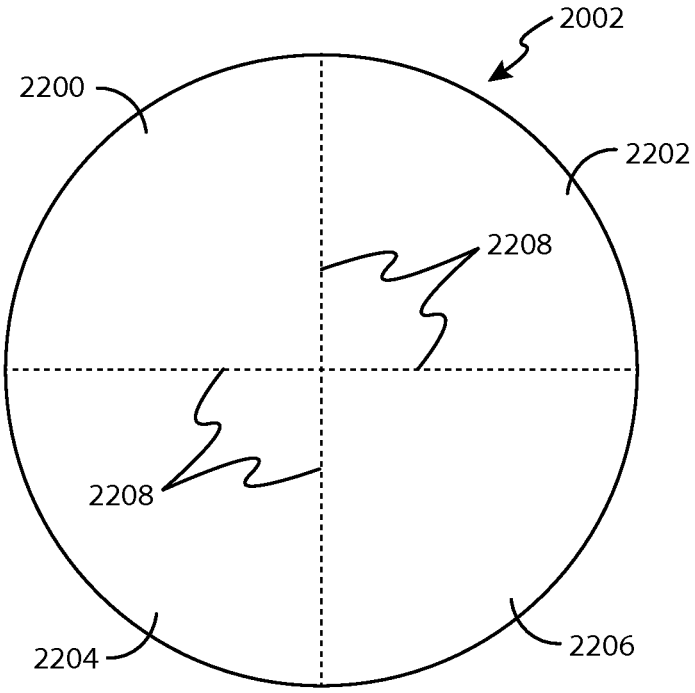
FIG. 22 is a top, plan view of another embodiment of the special footing shown in FIGS. 20 and 21.

FIG. 21 is a perspective view of footing 2002 used in the embodiment shown in FIG. 20. Footing 2002 comprises a body 2100, mating portion 2102 extending underneath body 2100, and slot 2104. As described previously with respect to footing 306, footing 2002 is removably attached to a socket formed into top surface 2008 of watercraft 200*b*, similar to sockets 202*a* and 202*b* discussed previously. Removable attachment may be accomplished in any of the ways mentioned previously. In one embodiment, mating portion 2102 extends into the socket for removable attachment using non-permanent hardware, threads, or other non-permanent fastening means. Slot 2104 is formed such that after footing 2002 has been attached to the socket, it faces rail 1014 so that end portion 2010 can be inserted therein. In a related embodiment, shown in FIG. 22, a number of slots may be formed in footing 2002 to allow a greater degree of flexibility with respect to the alignment of any slot with rail 1014, and to further prevent lateral movement of end portion 2010. FIG. 22 is a top, plan view of such an embodiment, showing four slots 2200, 2202, 2204, and 2206 formed by walls 2208 inside footing 2002. In this embodiment, end portion 2010 may be shaped to conform to the shapes of the slots, in this example, a triangular or pie-shaped. Then as end portion is seated within one of the slots that is closest to facing rail 1014, end portion is inserted into the particular slot, and seats against two of the walls 2208, thereby preventing lateral movement.

Figure 23A:
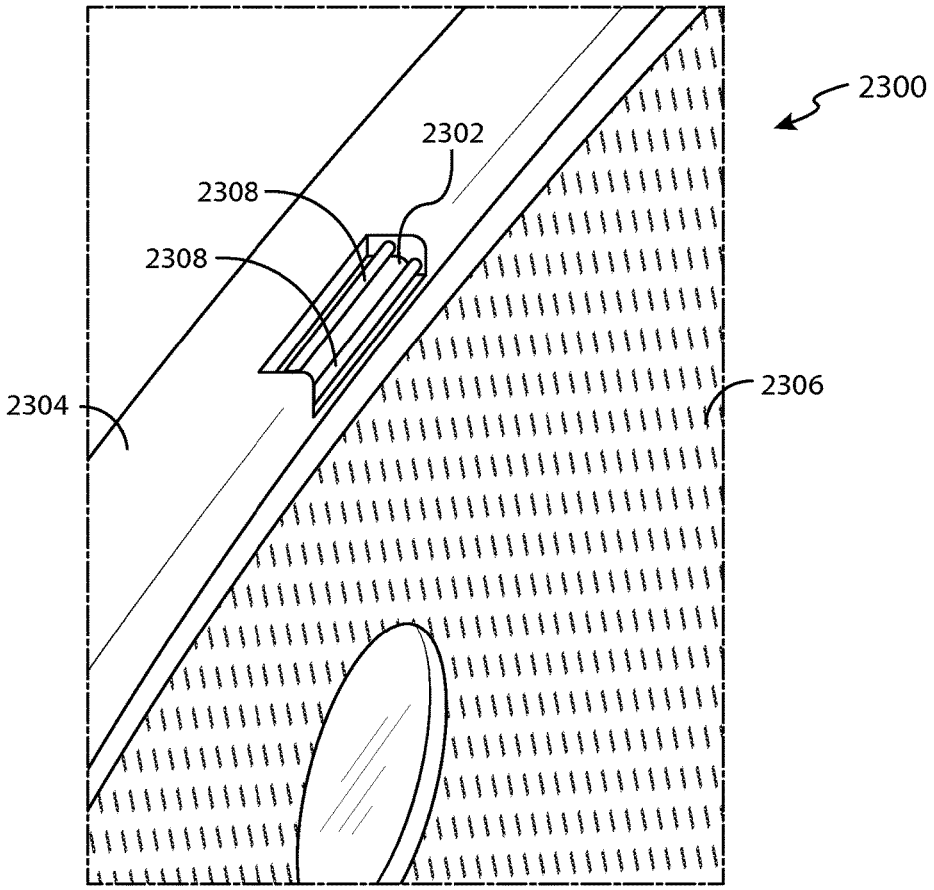
FIG. 23*a* is a perspective view of a tail section of the watercraft shown in FIG. 2, illustrating another embodiment for removably attaching the connecting structures of FIG. 17 to the watercraft with the use of draw latches.
Figure 23B:
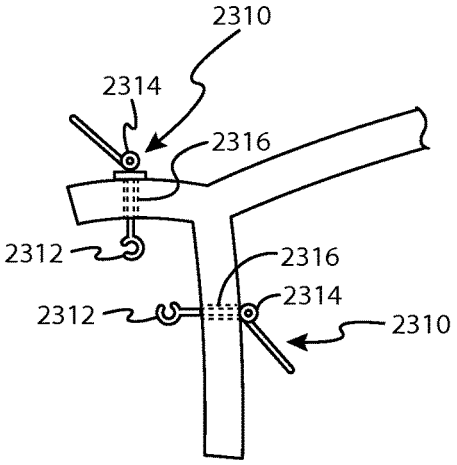
FIG. 23*b* is a side, plan view of one end of the connection structures shown in FIG. 23*a;*

FIG. 23*a* is a perspective view of a tail section 2300 of watercraft 200, illustrating another embodiment for removably attaching connecting structures 1702 to rotated watercraft 200. In this embodiment, draw latches are used to make the connection. FIG. 23*a* shows recess 2302 formed into the rail 2304 and top surface 2306 of watercraft 200. Inside recess 2302 are two attachment bars 2308 that are used by respective draw latches 2310 mounted at both ends of each connecting structure 1702. During installation of connecting structures 1702 to rotated watercraft 200, each end of each connecting structure 1702 is placed over a respective one of the recesses (FIG. 23*b* illustrates this detail). A hook 2312 of each latch hook 2310 engages a respective one of the attachment bars 2308 and then each hook 2310 is pulled tight against each attachment bar 2308 by placing latching mechanism 2314 into a "locked" position. Each latching mechanism 2314 is mechanically connected to a respective hook 2312 via a linkage that extends through respective holes 2316 in end portions of connecting structures 1702.

Figure 24:
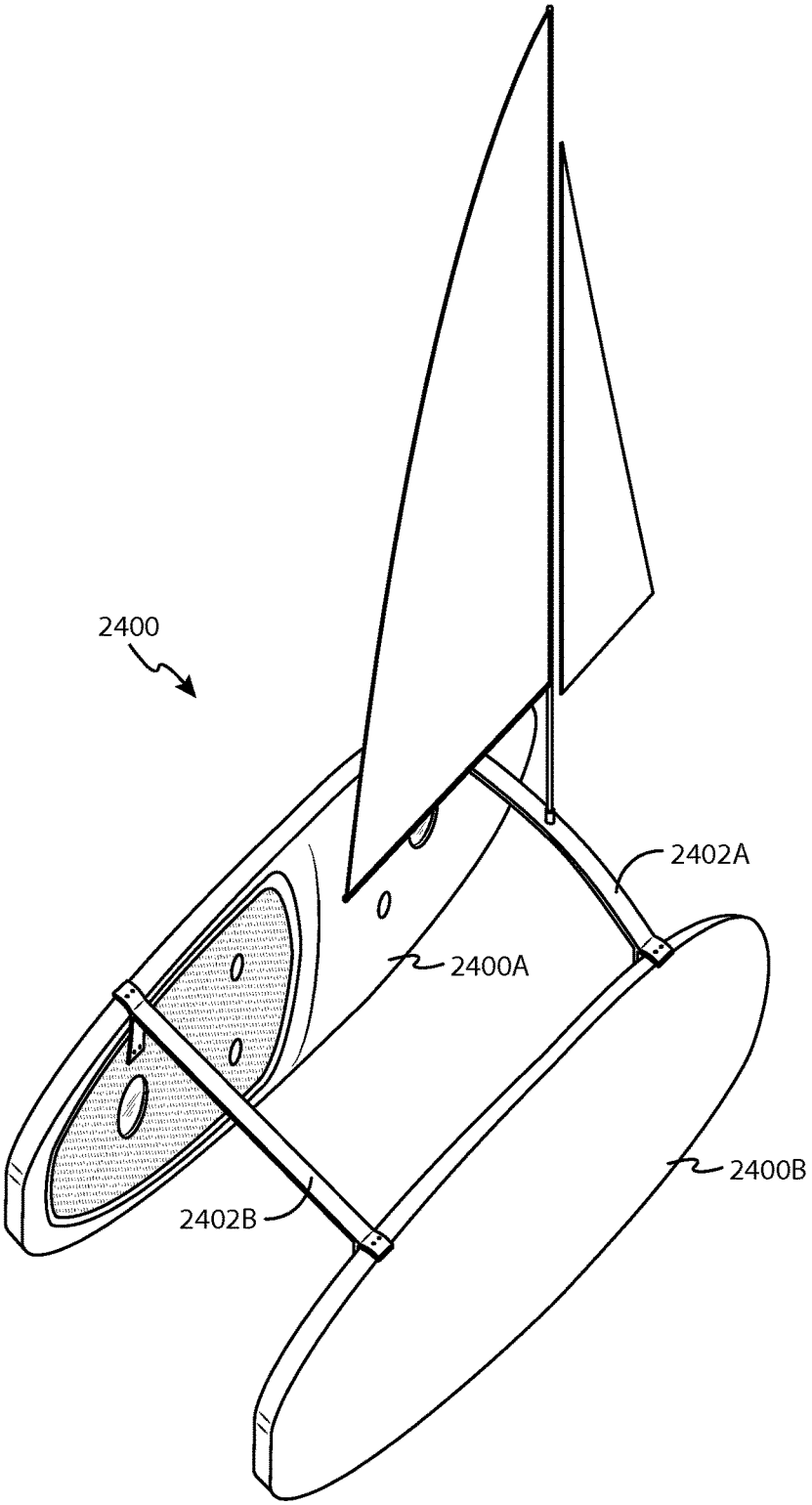
FIG. 24 is a perspective view of still yet another embodiment of a multi-use, configurable watercraft, comprising two of the watercraft shown in FIG. 2, both rotated about their respective longitudinal axis.

FIG. 24 is a perspective view of still yet another type of watercraft 2400 that utilizes two watercraft 200, each rotated approximately 90 degrees around their respective longitudinal axis from its usual flat position on the water when used alone in a paddleboard water activity. Shown are rotated watercraft 2400*a*, a second, rotated watercraft 2400*b*, and connecting structures, or cross-members, 2402*a* and 2402*b*. Watercraft 2400*b* is of the same or similar watercraft type as watercraft 2400*a* (i.e., paddleboard, SUP, surfboard, etc.), or it may be of a different type. Cross-member 2402*a* is shown with a "bowed" structure, while cross-member 2402*b* is shown having a different structure, in this embodiment, substantially straight. It should be understood that in other embodiments, the cross-members could have the same structure as each other, whether bowed, substantially straight, or some other geometric configuration.

The second watercraft 2400*b* may be the same size as watercraft 2400*a*, or it may be smaller. For example, watercraft 2400*a* may be 12 feet long and 28 inches wide at its widest point, while watercraft 2400*b* may be only 8 feet long and 20 inches wide at its widest point.

Watercraft 2400*a* and watercraft 2400*b* may be oriented with respect to one another in any one of four combinations, such as the top surfaces of each watercraft facing each other or away from each other, the top surface of one facing a bottom surface of the other, or vice-versa. It may be advantageous to have each watercraft's top surface face each other, as shown in FIG. 24, because doing so may provide a more stable platform during use.

Cross-members 2402 are each attached to the watercraft as shown in FIG. 24, in any of the ways described previously with respect to FIGS. 17-23. The detail of such removable attachment has been omitted from FIG. 24 for clarity.

A variety of water activities are possible using the two rotated watercraft of FIG. 24 when configured with various attachments. For example, watercraft 2400 could be configured as a dual-hull motorboat, sailboat, or catamaran using the components discussed with respect to FIGS. 3-11, i.e., a mast and sail, rudder, motor, bench, deck, trampoline, etc. In a dual-hull motorboat configuration, a motor could be removably mounted to the tail section of one watercraft 200*a* as shown in FIG. 9, while a rudder could be removably attached to the tail section of the other watercraft 200*b* as shown in FIG. 11. In another dual-hull motorboat embodiment, two motors could be removably mounted to the tail sections, one motor for each watercraft 200. In a dual-hull sailboat or catamaran embodiment, two rudders could be used, one mounted to the tail section of each watercraft 200, as shown in FIGS. 11 and 24.

Figure 25:
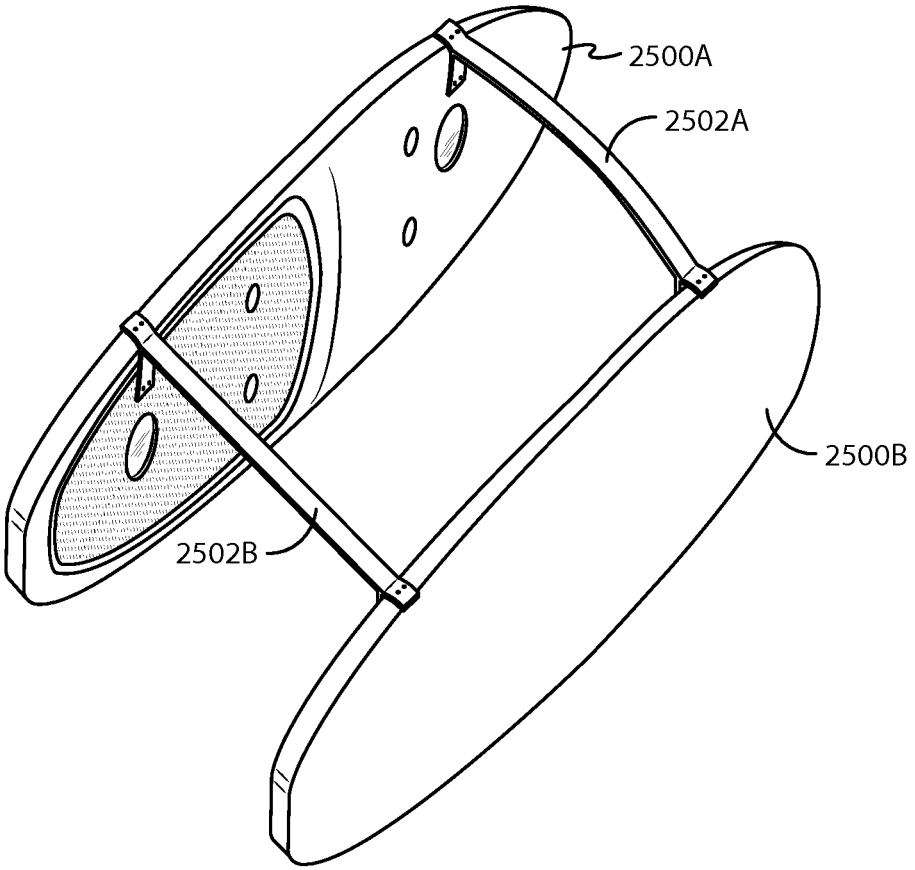
FIG. 25 is a perspective view of yet another embodiment of a multi-use, configurable watercraft, comprising two rotated watercraft removably attached to each other via cross-members.

FIG. 25 is a perspective view of one embodiment of watercraft 2400, shown as watercraft 2500, comprising two rotated watercraft 200 as watercraft 2500*a* and watercraft 2500*b*, two cross-members 2502*a* and 2502*b*, and mast mount 2504. In this embodiment, watercraft 2500 comprises an outrigger sailboat. Additional components of watercraft 2500, such as a mast, sail, decking, rudders, seats, etc., have been omitted in order to illustrate an inventive concept of the location of mast mount 2504.

In this embodiment, watercraft 2500*b* is smaller than watercraft 2500*a* in length, which results in a center of buoyancy between watercraft 2500*a* and watercraft 2500*b* to be located closer to watercraft 2500*a* than a mid-point between watercraft 2500*a* and watercraft 2500*b*. Thus, mast mount 2504, in this embodiment, is located closer to watercraft 2500*a* on cross-member 2502*a*, as shown, than midway between watercraft 2500*a* and watercraft 2500*b* as would be the case if both watercraft 2500*a* and watercraft 2500*b* were the same dimensions and, hence, buoyancy. Watercraft 2500*b* may comprise the same or similar watercraft type as watercraft 2500*a* (i.e., paddleboard, SUP, surfboard, etc.), or it may be of a different type. Mast mount 2504 may comprise a structure the same or similar to mast mount 420 and may rise above the surface of cross-member 2502*a* as shown or be entirely contained with cross-member 2502*a* as a recession. Cross-members 2502*a* and 2502*b* are each attached to the watercraft as shown in FIG. 25, in any of the ways described previously with respect to FIGS. 17-23.

Figure 26A:
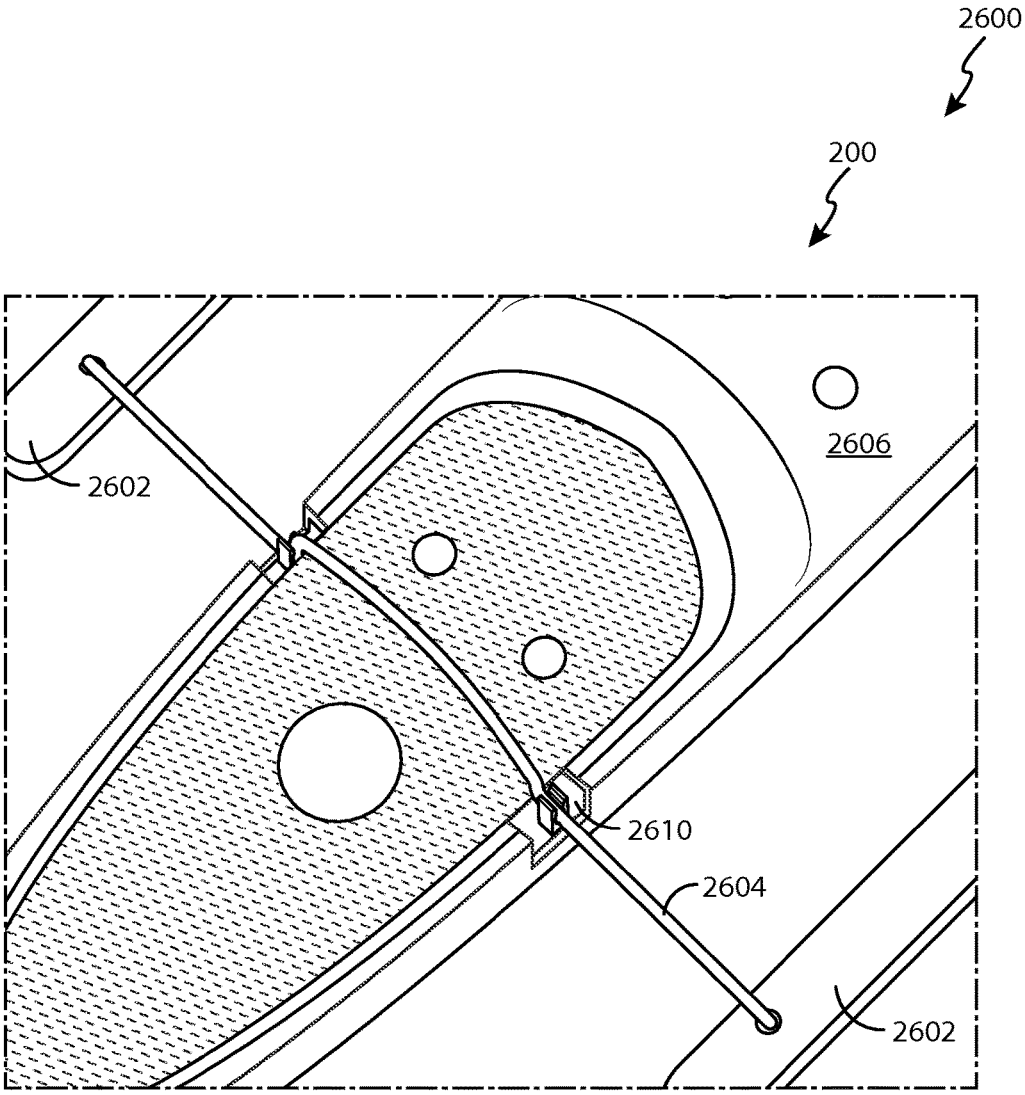
FIG. 26*a* is a perspective view of yet another embodiment of a configurable, multi-use watercraft.
Figure 26B:
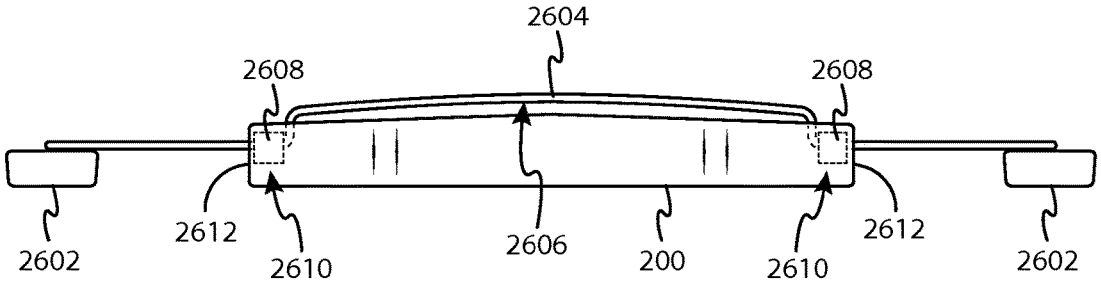
FIG. 26*b* is a rear, plan view of the watercraft shown in FIG. 26*a*.
Figure 26C:
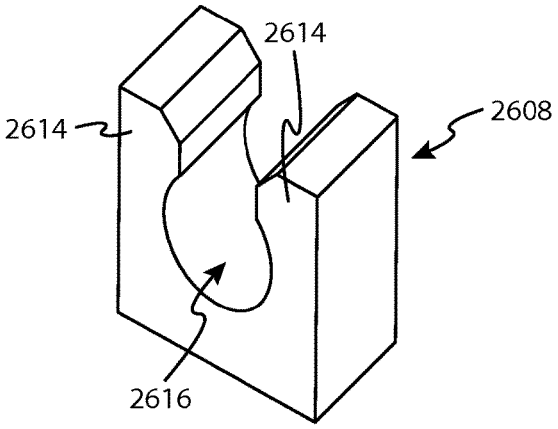
FIG. 26*c* is a close up, perspective view of a clamping mechanism used in the embodiment of FIG. 26*a*.

FIG. 26*a* is a perspective view of yet another embodiment of a configurable, multi-use watercraft 2600 formed from watercraft 200 and having two outriggers 2602 removably attached to the watercraft 200 via a single connecting structure 2604. In this embodiment, the connecting structure 2604 is constructed of a rigid material such as metal, plastic, or fiberglass, and comprises a cross section of virtually any shape, such as circular, triangular, square, etc. Connecting structure 2604 is shaped to conform to a width of top surface 2606, best shown in FIG. 26*b*, which is a rear, plan view of watercraft 2600. Connecting structure 2604 is removably attached to watercraft 200 via clamping mechanisms 2608, shown in close up in FIG. 26*c*. Clamping mechanisms 2608 are located in recesses 2610 formed into top surface 2606 and rails 2612 of watercraft 200. Cross-member 2604 may be removably attached to watercraft 200 by placing cross-member 2604 over each clamping mechanism and applying a downward force, thereby opening jaws 2614 and seating within opening 2616. Thereafter, jaws 2614 return to their original position, which secures connecting structure 2604 within clamping mechanism 2608 under normal load conditions as watercraft 2600 is used as an outrigger stand-up paddleboard. When it is desired to use watercraft 200 as a stand-up paddleboard, cross-member 2604 and outriggers 2602 are removed by pulling cross-member 2604 in an upwards direction with enough force to overcome the clamping effect caused by jaws 2614 of clamping mechanism 2608. In alternative embodiments, a variety of fastening devices could be used alternatively, or in addition, to clamping mechanism 2608, such as quick-release fasteners, latch hooks, or any other fastener capable of securing cross-member 2604 in place as watercraft 2600 is used as an outrigger, stand-up paddleboard.

The previous description of the preferred embodiments is provided to enable any person skilled in the art to make and use the concepts described herein. The various modifications to these embodiments will be readily apparent to those skilled in the art, and the generic principles defined herein may be applied to other embodiments without the use of the inventive faculty. Thus, the ideas presented are not intended to be limited only to the embodiments discussed herein, but are to be accorded the widest scope consistent with the principles and novel features disclosed herein.

We claim:

1. A multi-use, configurable watercraft, comprising:

when configured as a single-hull watercraft for use in a first water-based activity, the multiuse, configurable watercraft comprises:

a first hull;

at least two sockets formed into a top surface of the first hull and spaced apart from each other along a longitudinal axis of the hull, each of the sockets configured to receive a respective footing when the first hull is configured for use as a multi-hull watercraft; and at least two removable socket covers, each socket cover for covering a respective one of the at least two sockets when the configurable, multi-use watercraft is configured for use as the single-hull watercraft and preventing each respective footing from being received by a respective one of the sockets;

and when configured as the multi-hull watercraft for use in a water-based activity different than the first water-based activity, the multi-use configurable watercraft additionally comprises:

a first removable footing secured into a first of the at least two sockets, the first, removable footing comprising a mast mount for reception of a mast, and a through hole formed horizontally through side walls of the first, removable footing for receiving a first outrigger connecting structure;

a second, removable footing secured into a second of the at least two sockets;

the first outrigger connecting structure having one end of inserted into the through hole of the first, removable footing;

a second outrigger connecting structure having one end secured to the second, removable footing; and an outrigger removably coupled to the first and second outrigger connecting structures for removable attachment to the first hull via the outrigger connecting structures.

2. The multi-use, configurable watercraft of claim 1, when configured as the multi-hull watercraft, further comprises:

a bench comprising at least a first transition fitting and a second transition fitting;

a first bench socket formed into the top surface of the first hull, configured to removably receive the first transition fitting; and a second bench socket formed into a top surface of the outrigger, configured to removably receive the second transition fitting.

3. The multi-use, configurable watercraft of claim 1, when configured as the multi-hull watercraft, further comprises:

a transom removably attached to a tail portion of the first hull; and an outboard motor attached to the transom.

4. The multi-use, configurable watercraft of claim 1, when configured as the multi-hull watercraft, further comprises:

a mast coupled to a mast mount formed into the first, removable footing;

a transom removably attached to a tail portion of the first hull; and a rudder attached to the transom.

5. The multi-use, configurable watercraft of claim 1, when configured as the multi-hull watercraft, further comprises:

fabric attached between the outrigger connecting structures forming a support area for individuals.

6. The multi-use, configurable watercraft of claim 1, when configured as the multi-hull watercraft, further comprises:

a second outrigger;

a third outrigger connecting structure for removably joining the second outrigger to the first hull via removable attachment to the through hole formed through the first, removable footing; and a fourth outrigger connecting structure for removably joining the second outrigger to the first hull via a removable attachment to the second, removable footing.

7. The multi-use, configurable watercraft of claim 1, when configured as the multi-hull watercraft, further comprises:

a cross-member transom removably attached to one of the outrigger connecting structure; and an outboard motor attached to the cross-member transom.

8. The multi-use, configurable watercraft of claim 1, further comprising:

the mast;

a transom removably attached to a tail portion of the first hull; and a rudder attached to the transom.

* * * * *